US009296215B2

(12) United States Patent
Osakabe et al.

(10) Patent No.: US 9,296,215 B2
(45) Date of Patent: Mar. 29, 2016

(54) LIQUID-CONSUMING APPARATUS

(71) Applicant: BROTHER KOGYO KABUSHIKI KAISHA, Nagoya-shi, Aichi-ken (JP)

(72) Inventors: Yoshinori Osakabe, Seto (JP); Tomohisa Higuchi, Nagoya (JP); Suguru Tomoguchi, Okazaki (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/734,185

(22) Filed: Jun. 9, 2015

(65) Prior Publication Data

US 2015/0360476 A1 Dec. 17, 2015

(30) Foreign Application Priority Data

Jun. 12, 2014 (JP) ..... 2014-121823

(51) Int. Cl.
*B41J 2/17* (2006.01)
*B41J 2/175* (2006.01)
*B41J 2/165* (2006.01)

(52) U.S. Cl.
CPC ..... *B41J 2/17553* (2013.01)

(58) Field of Classification Search
CPC ..... B41J 2/16505
USPC ..... 347/29, 84–86
See application file for complete search history.

(56) References Cited

U.S. PATENT DOCUMENTS

| | | | | |
|---|---|---|---|---|
| 5,686,947 | A | 11/1997 | Murray et al. | |
| 6,565,197 | B1 * | 5/2003 | Murray | B41J 2/1752 347/85 |
| 7,461,929 | B2 * | 12/2008 | Sasaki | B41J 2/17506 347/85 |
| 2011/0096127 | A1 | 4/2011 | Ishibe et al. | |
| 2012/0092716 | A1 * | 4/2012 | Ichimura | B41J 2/16505 358/1.15 |

FOREIGN PATENT DOCUMENTS

| | | | |
|---|---|---|---|
| JP | 11-504874 | A | 5/1999 |
| JP | 2001-328252 | A | 11/2001 |
| JP | 2005-067168 | A | 3/2005 |
| JP | 2005-074979 | A | 3/2005 |
| JP | 2011-088365 | A | 5/2011 |

* cited by examiner

*Primary Examiner* — Jason Uhlenhake
(74) *Attorney, Agent, or Firm* — Merchant & Gould PC

(57) ABSTRACT

A liquid-consuming apparatus includes: a tank including a liquid storage chamber configured to store a liquid, an inlet through which the liquid is poured into the liquid storage chamber, and a liquid flow channel configured to let the liquid flow therethrough from the liquid storage chamber; a cap configured to be attachable to the tank to cover the inlet; a cover configured to be movable relative to the tank between a closed position where a surface, of the tank, in which the inlet is formed is covered and an open position where the surface of the tank is exposed; and a holder configured to hold the cap removed from the tank. The cover is prevented from moving to the closed position by the cap held by the holder to be positioned in a movement area of the cover moving from the open position to the closed position.

13 Claims, 19 Drawing Sheets

LIQUID-CONSUMING APPARATUS

CROSS REFERENCE TO RELATED APPLICATION

The present application claims priority from Japanese Patent Application No. 2014-121823, filed on Jun. 12, 2014, the disclosure of which is incorporated herein by reference in its entirety.

BACKGROUND OF THE INVENTION

1. Field of the Invention

The present invention relates to a liquid-consuming apparatus including a tank with an inlet for liquid, a cap to cover the inlet of the tank, and a cover by which the tank is covered and exposed.

2. Description of the Related Art

There is conventionally known a printer (an exemplary liquid-consuming apparatus) having a capacious tank which can be replenished with ink and a recording head which discharges the ink supplied from the tank from nozzles to record an image on a recording sheet. The tank has an inlet for the ink, and the inlet can be opened or covered with a cap. The ink can be poured into the tank through the inlet from which the cap is removed.

SUMMARY OF THE INVENTION

By the way, when a user supplies the ink to the tank, the user may put the cap removed from the inlet on a placement surface such as a desk. This could dirty the placement surface due to the adhesion of the ink. Further, the user could lose the removed cap. If the user forgets to cover the inlet with the cap after supplying the ink, the printer will be used in a state that the inlet of the tank is open. In such a case, there is fear that the viscosity of ink and the like might change due to the evaporation of moisture of the ink in the tank through the inlet, that dust and the like might enter into the tank through the inlet, and that the ink might leak from the inlet.

The present teaching has been made in view of the above-mentioned circumstances, and an object of the present teaching is to provide a means by which a liquid-consuming apparatus is prevented from being used in a state that an inlet of a tank is not covered with a cap.

According to an aspect of the present teaching, there is provided a liquid-consuming apparatus, including: a tank including a liquid storage chamber configured to store a liquid, an inlet configured to allow the liquid to be poured into the liquid storage chamber, and a liquid flow channel configured to let the liquid flow therethrough from the liquid storage chamber; a cap configured to be attachable to the tank to cover the inlet; a cover configured to be movable relative to the tank between a closed position and an open position, the closed position being a position where a surface, of the tank, in which the inlet is formed is covered with the cover, the open position being a position where the surface, of the tank, in which the inlet is formed is exposed; and a holder configured to hold the cap removed from the tank, wherein the cover is configured to be prevented from moving to the closed position by the cap held by the holder and positioned in a movement area of the cover moving from the open position to the closed position.

Moving the cover to the open position enables a user to access the inlet of the tank. Removing the cap from the inlet of the tank enables the user to replenish the tank with liquid. The cap removed from the inlet is held by the holder. This prevents the loss of the cap and the dirt or stain on a placement surface, which would be otherwise caused by putting the cap on the placement surface. When the user moves the cover from the open position to the closed position in a state that the cap is held by the holder to make the inlet open, the cap positioned in the movement area of the cover obstructs the movement of the cover. This enables the user to know that the cap is not attached to the inlet.

According to the present teaching, holding the cap by the holder prevents the loss of the cap and the dirt or stain on the placement surface, which would be otherwise caused by putting the cap on the placement surface. Further, the cover is prevented from moving to the closed position by the cap held by the holder to be positioned in the movement area of the cover. Thus, the liquid-consuming apparatus is prevented from being used in the state that the inlet of the tank is not covered with the cap.

BRIEF DESCRIPTION OF THE DRAWINGS

FIGS. 1A and 1B are perspective views of outer appearances of a multifunction peripheral, wherein FIG. 1A depicts a state that a cover is closed, and FIG. 1B depicts a state that the cover is open.

DESCRIPTION OF THE EMBODIMENTS

Figure 1A:
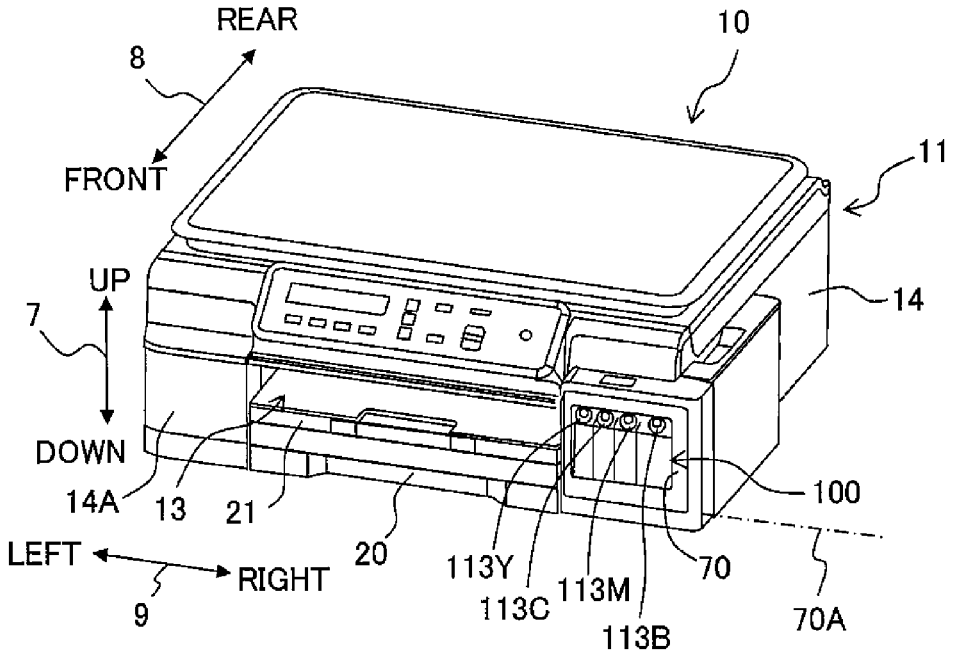

In the following, an explanation will be made about an embodiment of the present teaching. It is needless to say that the embodiment to be explained below is merely an example of the present teaching, and it is possible to appropriately change the embodiment of the present teaching without departing from the gist and scope of the present teaching. In the following explanation, the state in which a multifunction peripheral 10 is placed to be usable (the state depicted in FIGS. 1A and 1B) is described as "usable state". Further, the posture in which the multifunction peripheral 10 is placed to be usable (the posture depicted in FIGS. 1A and 1B) is described as "usable posture". An up-down direction 7 is defined on the basis of the usable state or usable posture. A front-rear direction 8 is defined as an opening 13 of the multifunction peripheral 10 is provided on the near side (the front side). A left-right direction 9 is defined as the multifunction peripheral 10 is viewed from the near side (the front side). The up-down direction 7 includes upward and downward directions as components thereof, and the upward direction is oriented against the downward direction. The left-right direction 9 includes leftward and rightward directions as components thereof, and the leftward direction is oriented against the rightward direction. The front-rear direction 8 includes frontward and rearward directions as components thereof, and the frontward direction is oriented against the rearward direction. Further, in this embodiment, the up-down direction 7 corresponds to a vertical direction and the front-rear direction 8 and the left-right direction 9 correspond to a horizontal direction.

<Entire Structure of Multifunction Peripheral 10>

Figure 1B:
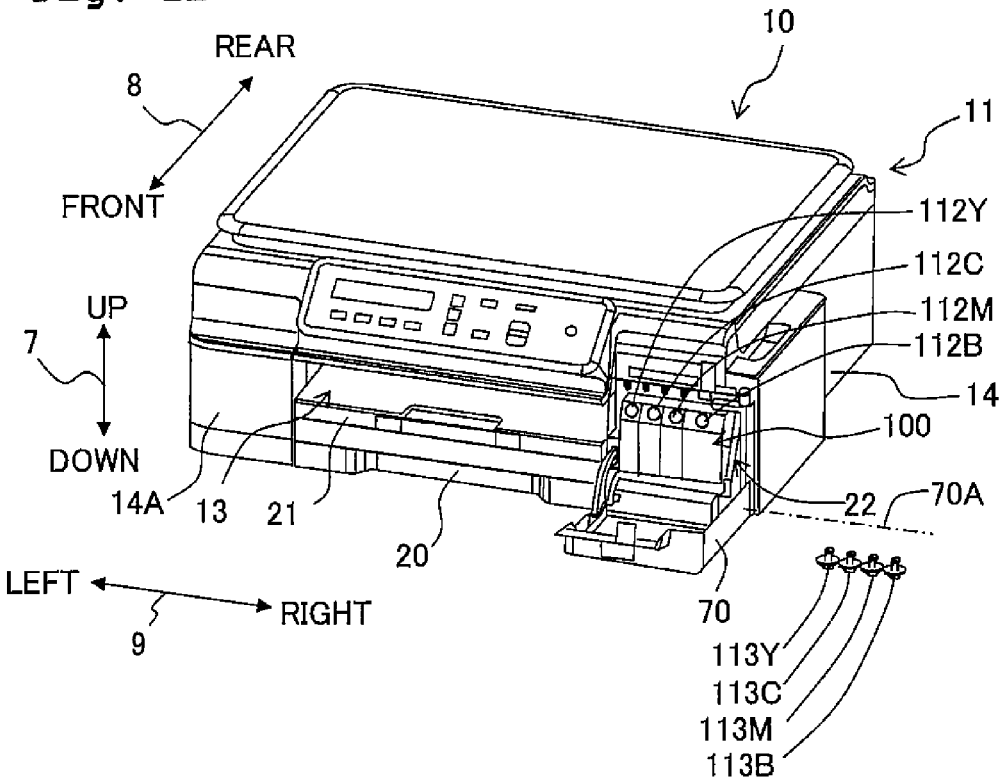
Figure 2:
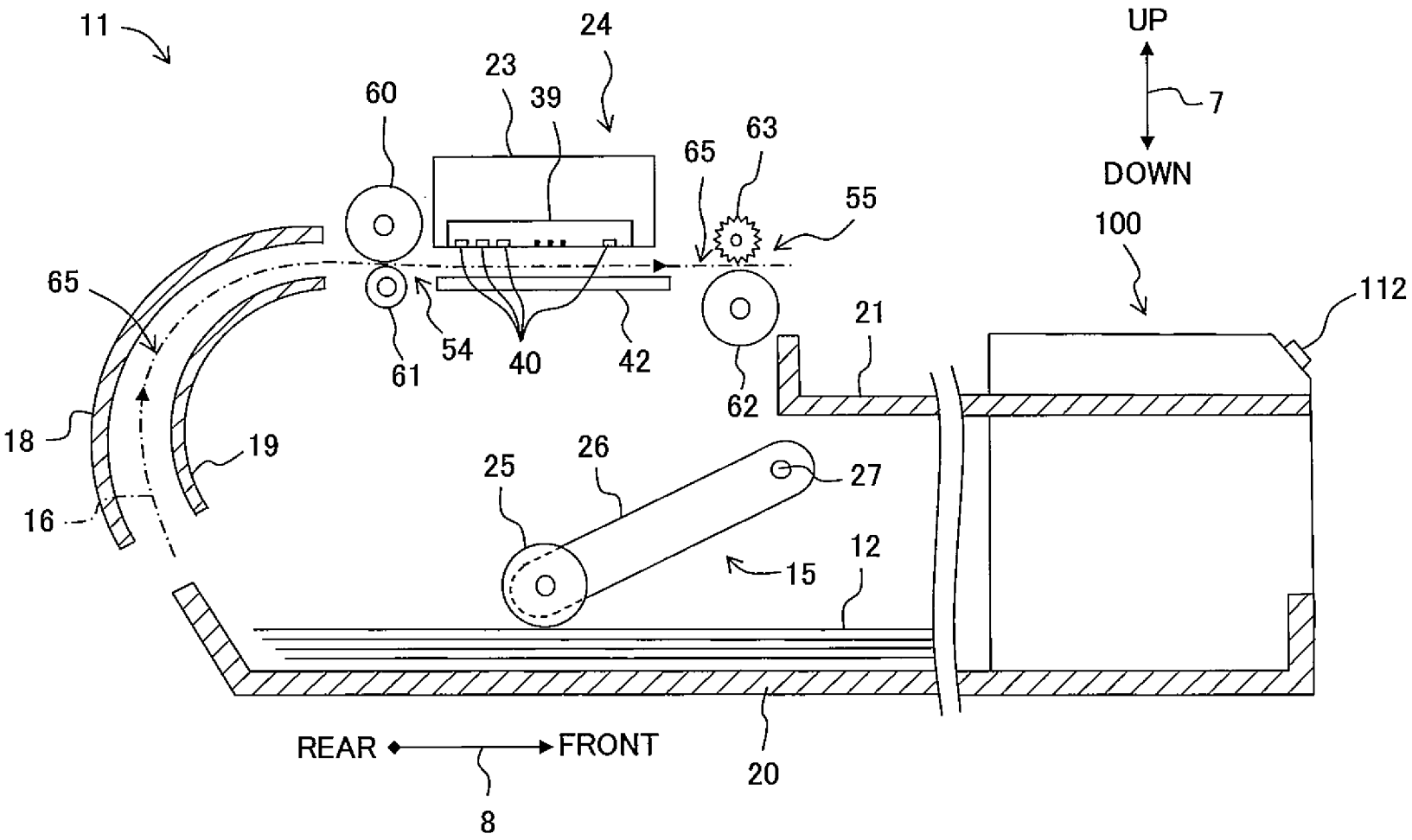
FIG. 2 is a vertical cross-sectional view schematically depicting the internal structure of a printer unit.

As depicted in FIGS. 1A and 1B, the multifunction peripheral 10 is formed to have an approximately cuboid form. A printer unit 11 of the ink jet recording system is provided at a lower part of the multifunction peripheral 10 to record an image on a sheet 12 (see FIG. 2). As depicted in FIG. 2, the printer unit 11 includes a feed unit 15, a feed tray 20, a discharge tray 21, a conveyance roller unit 54, a recording unit 24, a discharge roller unit 55, a platen 42, and an ink tank 100 (an exemplary tank). The multifunction peripheral 10 includes various functions such as a facsimile function and a print function. The multifunction peripheral 10 is an exemplary liquid-consuming apparatus.

Figure 14:
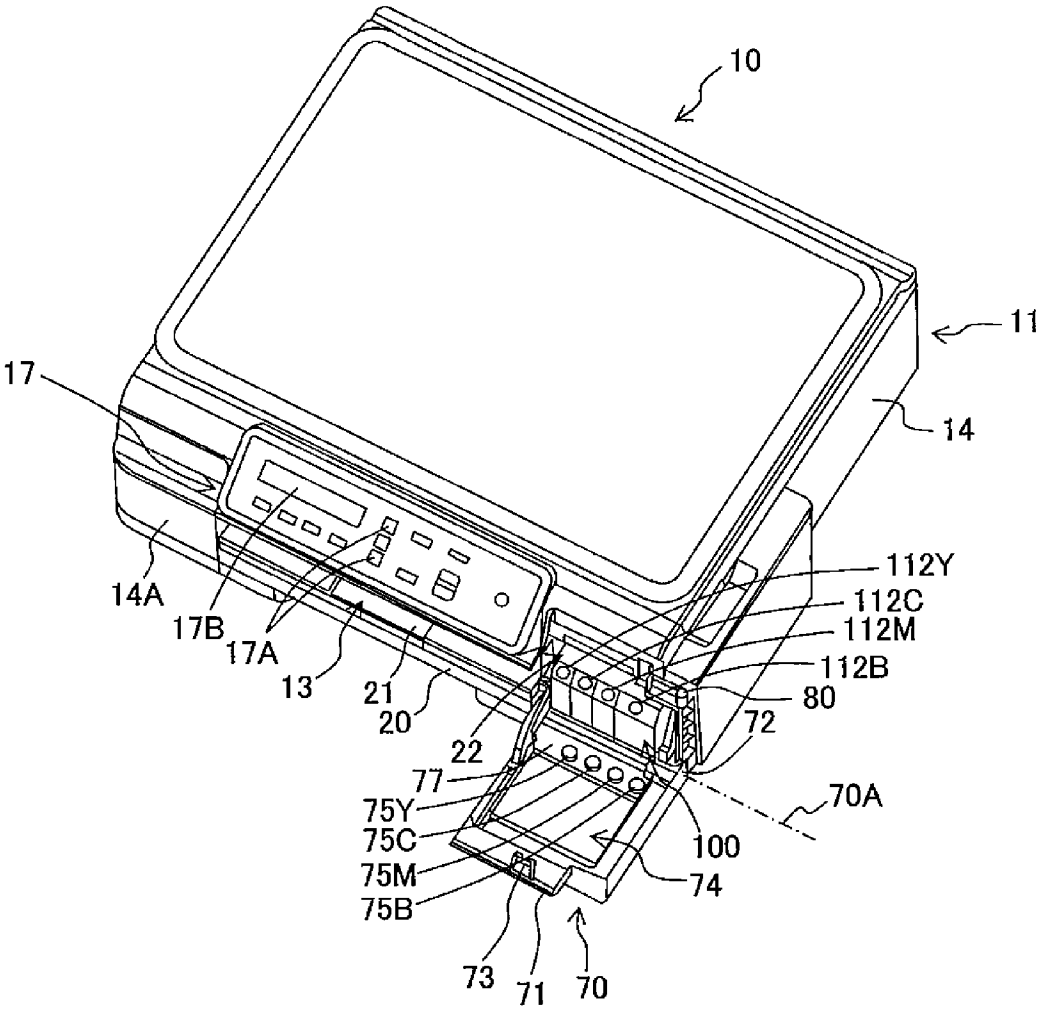
FIG. 14 is a perspective view of the outer appearance of the multifunction peripheral of which cover is open.

As depicted in FIG. 14, an operation panel 17 is provided on a front wall 14A of a housing 14 of the printer unit 11 to be positioned above the opening 13. The operation panel 17 includes input buttons 17A and a liquid crystal display 17B (an exemplary report unit) on the surface thereof. The operation panel 17 is configured to extend in the left-right direction 9, and the surface of the operation panel 17 faces obliquely upward. The operation panel 17 is disposed above the ink tank 100 which will be described later.

<Feed Tray 20, Discharge Tray 21>

As depicted in FIGS. 1A and 1B, the opening 13 is formed at the central part in the left-right direction 9 of the front surface of the multifunction peripheral 10. The feed tray 20 is inserted to and pulled or drawn out of the multifunction peripheral 10 by a user in the front-rear direction 8 via the opening 13. The feed tray 20 can support a plurality of sheets 12 stacked thereon. The discharge tray 21 is disposed above the feed tray 20, and the discharge tray 21 is inserted to and pulled or drawn out of the multifunction peripheral 10 together with the feed tray 20. The discharge tray 21 supports each sheet 12 which is discharged by the discharge roller unit 55 from the space between the recording unit 24 and the platen 42.

<Feed Unit 15>

The feed unit 15 feeds each sheet 12 supported by the feed tray 20 to a conveyance path 65. As depicted in FIG. 2, the feed unit 15 includes a feed roller 25, a feed arm 26, and a shaft 27. The feed roller 25 is rotatably supported on the side of the forward end of the feed arm 26. The reverse rotation of a conveyance motor (not depicted) rotates the feed roller 25 in the direction in which the sheet 12 is conveyed in a conveyance direction 16. In the following, the rotations of the feed roller 25, the conveyance roller 60, and a discharge roller 62 in the direction in which the sheet 12 is conveyed in the conveyance direction 16 are described as "forward (normal) rotation". The feed arm 26 is swingably supported by the shaft 27 which is supported by a frame of the printer unit 11. The feed arm 26 is biased to swing toward the feed tray 20 by self-weight or the elastic force of a spring or the like.

<Conveyance Path 65>

Figure 3:
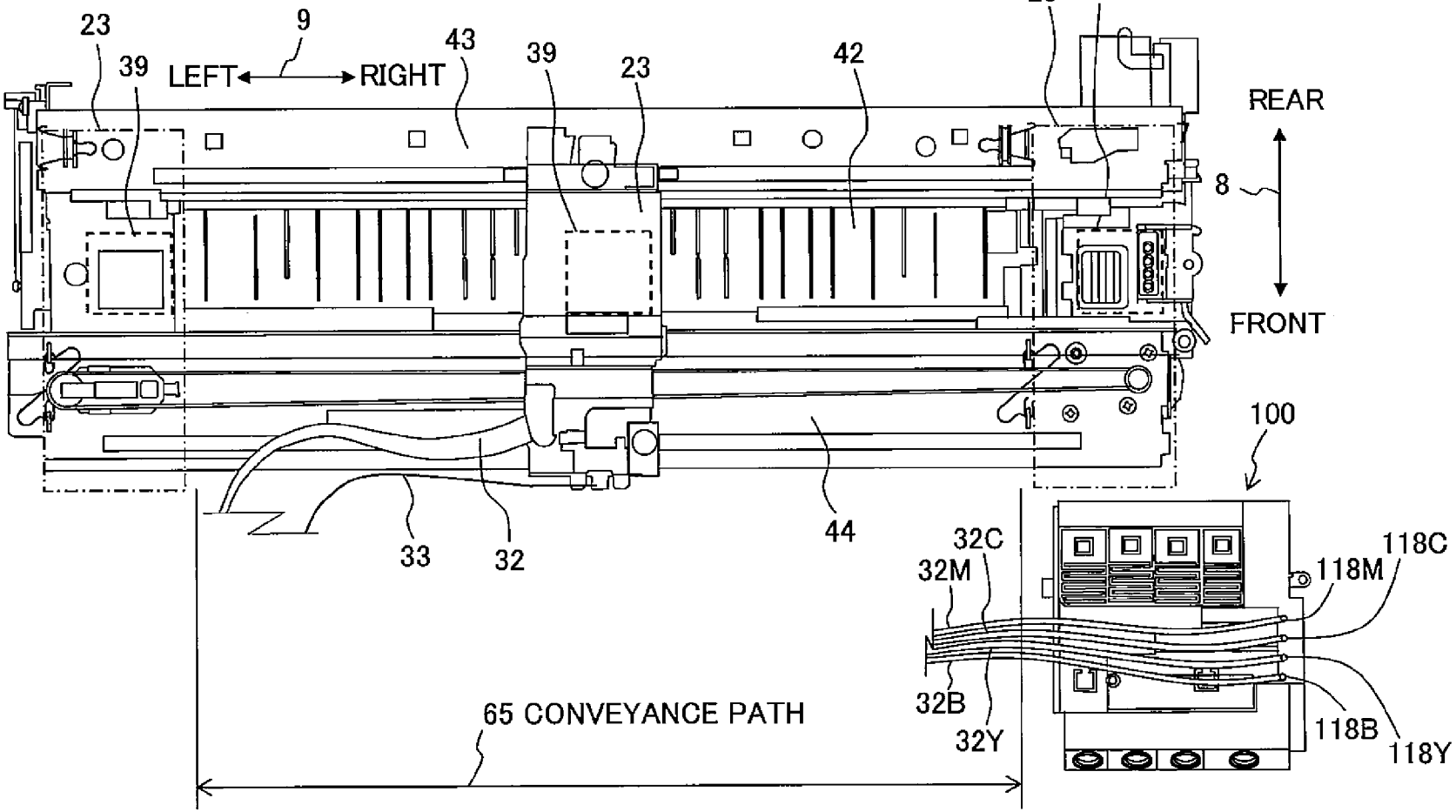
FIG. 3 is a plan view depicting the arrangement of a carriage and an ink tank.

As depicted in FIG. 2, the conveyance path 65 is a path which extends from the rear end of the feed tray 20 toward the rear side of the printer unit 11, extends from the lower side to the upper side in the up-down direction 7 on the rear side of the printer unit 11 while being curved to make a U-turn, and passes through the space between the recording unit 24 and the platen 42 to arrive at the discharge tray 21. A part of the conveyance path 65 is formed by an outer guide member 18 and an inner guider member 19 facing each other while being separated by a predetermined interval in the printer unit 11. Further, as depicted in FIGS. 2 and 3, a part of the conveyance path 65, which is positioned between the conveyance roller unit 54 and the discharge roller unit 55 in the front-rear direction 8, is substantially in the center of the multifunction peripheral 10 in the left-right direction 9 to extend in the front-rear direction 8. The conveyance direction 16 of the sheet 12 in the conveyance path 65 is depicted by arrows indicated by dashed-dotted lines in FIG. 2.

<Conveyance Roller Unit 54>

As depicted in FIG. 2, the conveyance roller unit 54 is disposed on the upstream side of the recording unit 24 in the conveyance direction 16. The conveyance roller unit 54 includes the conveyance roller 60 and a pinch roller 61 facing each other. The conveyance roller 60 is driven by the conveyance motor. The pinch roller 61 rotates accompanying with the rotation of the conveyance roller 60. The sheet 12 is conveyed in the conveyance direction 16 while being held or nipped by the conveyance roller 60 and the pinch roller 61 which rotate in the forward direction due to the forward rotation of the conveyance motor.

<Discharge Roller Unit 55>

As depicted in FIG. 2, the discharge roller unit 55 is disposed on the downstream side of the recording unit 24 in the conveyance direction 16. The discharge roller unit 55 includes the discharge roller 62 and a spur roller 63 facing each other. The discharge roller 62 is driven by the conveyance motor. The spur roller 63 rotates accompanying with the rotation of the discharge roller 62. The sheet 12 is conveyed in the conveyance direction 16 while being held or nipped by the discharge roller 62 and the spur roller 63 which rotate in the forward direction due to the forward rotation of the conveyance motor.

<Recording Unit 24>

As depicted in FIG. 2, the recording unit 24 is disposed between the conveyance roller unit 54 and the discharge roller unit 55 in the conveyance direction 16. Further, the recording unit 24 is disposed to face the platen 42 in the up-down direction 7 with the conveyance path 65 intervening therebetween. That is, the recording unit 24 is disposed above the conveyance path 65 in the up-down direction 7 to face the conveyance path 65. The recording unit 24 includes a carriage 23 and a recording head 39.

As depicted in FIG. 3, the carriage 23 is supported by guide rails 43, 44 which extend in the left-right direction 9 in a state of being separated in the front-rear direction 8. The guide rails 43, 44 are supported by the frame of the printer unit 11. The carriage 23 is connected to a known belt mechanism provided for the guide rail 44. The belt mechanism is driven by a carriage motor (not depicted). That is, the carriage 23 connected to the belt mechanism reciprocates in the left-right direction 9 by the drive of the carriage motor. The carriage 23 moves leftward and rightward beyond the conveyance path 65 in the left-right direction 9 as depicted by dashed-dotted lines in FIG. 3.

Ink tubes 32 and a flexible flat cable 33 lead from the carriage 23. The ink tubes 32 connect the ink tank 100 and the recording head 39, and the flexible flat cable 33 electrically connects a control board mounting a controller (not depicted) and the recording head 39. The inks stored in the ink tank 100 are supplied to the recording head 39 through the ink tubes 32. More specifically, four ink tubes 32B, 32M, 32C, and 32Y, through which black, magenta, cyan, and yellow inks pass respectively, lead from the ink tank 100 and are connected to the carriage 23 in a state of being mutually bound. The four ink tubes 32B, 32M, 32C, and 32Y will be described collectively as "ink tubes 32" in some cases. A control signal to be outputted from the controller is transmitted to the recording head 39 via the flexible flat cable 33.

As depicted in FIG. 2, the recording head 39 is carried on the carriage 23. A plurality of nozzles 40 are formed on the lower surface of the recording head 39. The tip portions of the nozzles 40 are exposed from the lower surfaces of the recording head 39 and the carriage 23 carrying the recording head 39. In the following, the surface from which the tip portions of the nozzles 40 are exposed will be described as "nozzle surface" in some cases. The recording head 39 discharges the ink(s) from the nozzles 40 as minute ink droplets. The recording head 39 discharges the ink droplets onto a sheet 12 supported by the platen 42 during the movement of the carriage 23. Accordingly, an image is recorded on the sheet 12.

<Platen 42>

As depicted in FIGS. 2 and 3, the platen 42 is disposed between the conveyance roller unit 54 and the discharge roller unit 55 in the conveyance direction 16. The platen 42 is disposed to face the recording unit 24 in the up-down direction 7 so as to support the sheet 12 conveyed by the conveyance roller unit 54 from the lower side of the sheet 12.

<Ink Tank 100>

As depicted in FIGS. 1A and 1B, the ink tank 100 is accommodated in the housing 14. The ink tank 100 is fixed to the multifunction peripheral 10 so as not to be removed from the multifunction peripheral 10 easily.

The front surface of the ink tank 100 is exposed to the outside of the multifunction peripheral 10 via the opening 22, which is formed in the front wall 14A of the housing 14. The opening 22 is adjacent to the opening 13 in the left-right direction 9. The housing 14 is provided with a cover 70 which is swingable between a closed position (see FIG. 1A) where the opening 22 is covered therewith and an open position (see FIG. 1B) where the opening 22 is exposed. The cover 70 is supported by the housing 14 to be swingable around a swing axis 70A as the center of swing. The swing axis 70A extends in the left-right direction 9 on the side of the lower end of the cover 70 in the up-down direction 7. The swing axis 70A is positioned to be closer to a lower end 72 than to an upper end 71 of the cover 70 (see FIG. 16), in a state that the cover 70 covers the opening 22(the state depicted in FIG. 1A).

Figure 4:
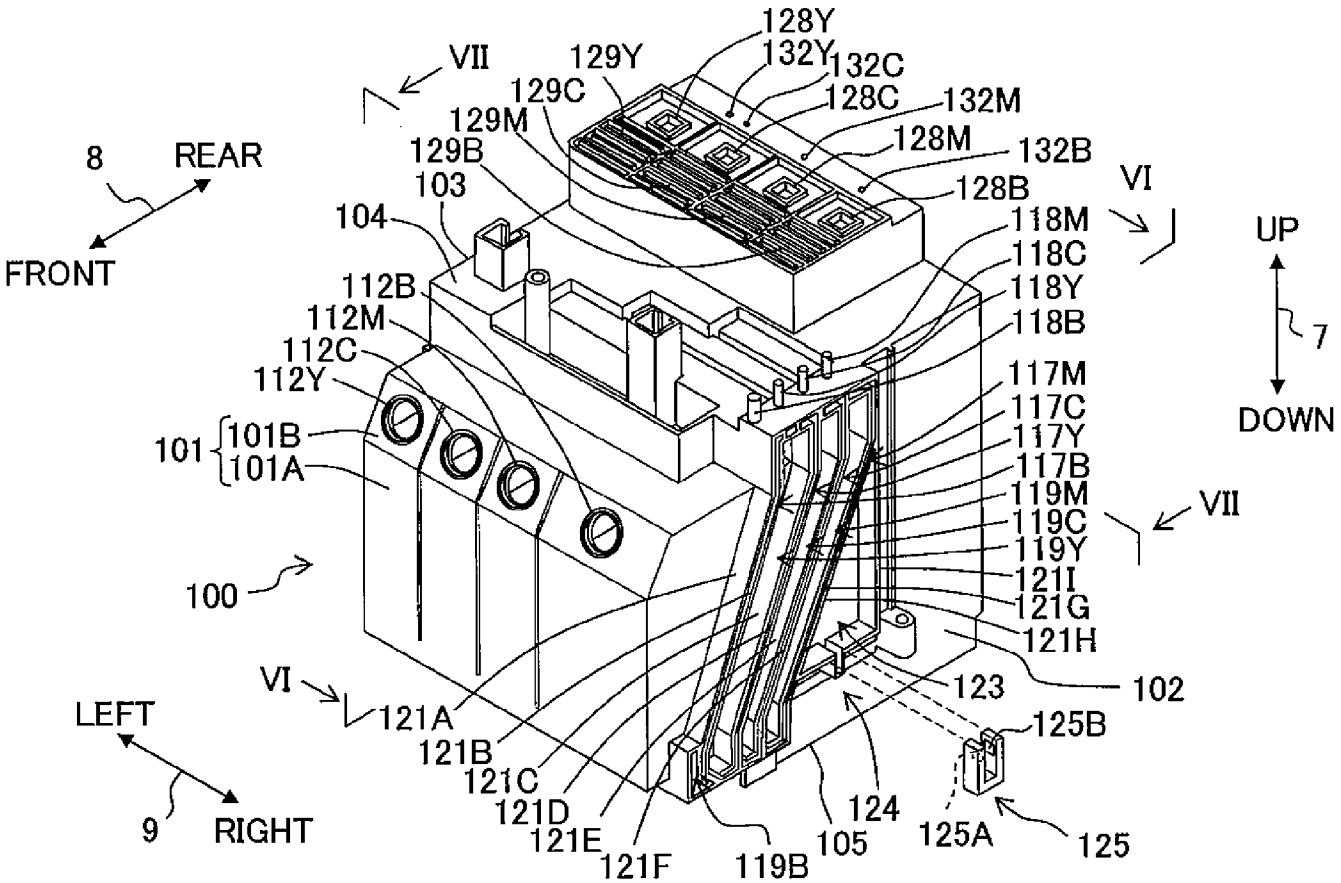
FIG. 4 is a perspective view of the ink tank as viewed from the front side.
Figure 5:
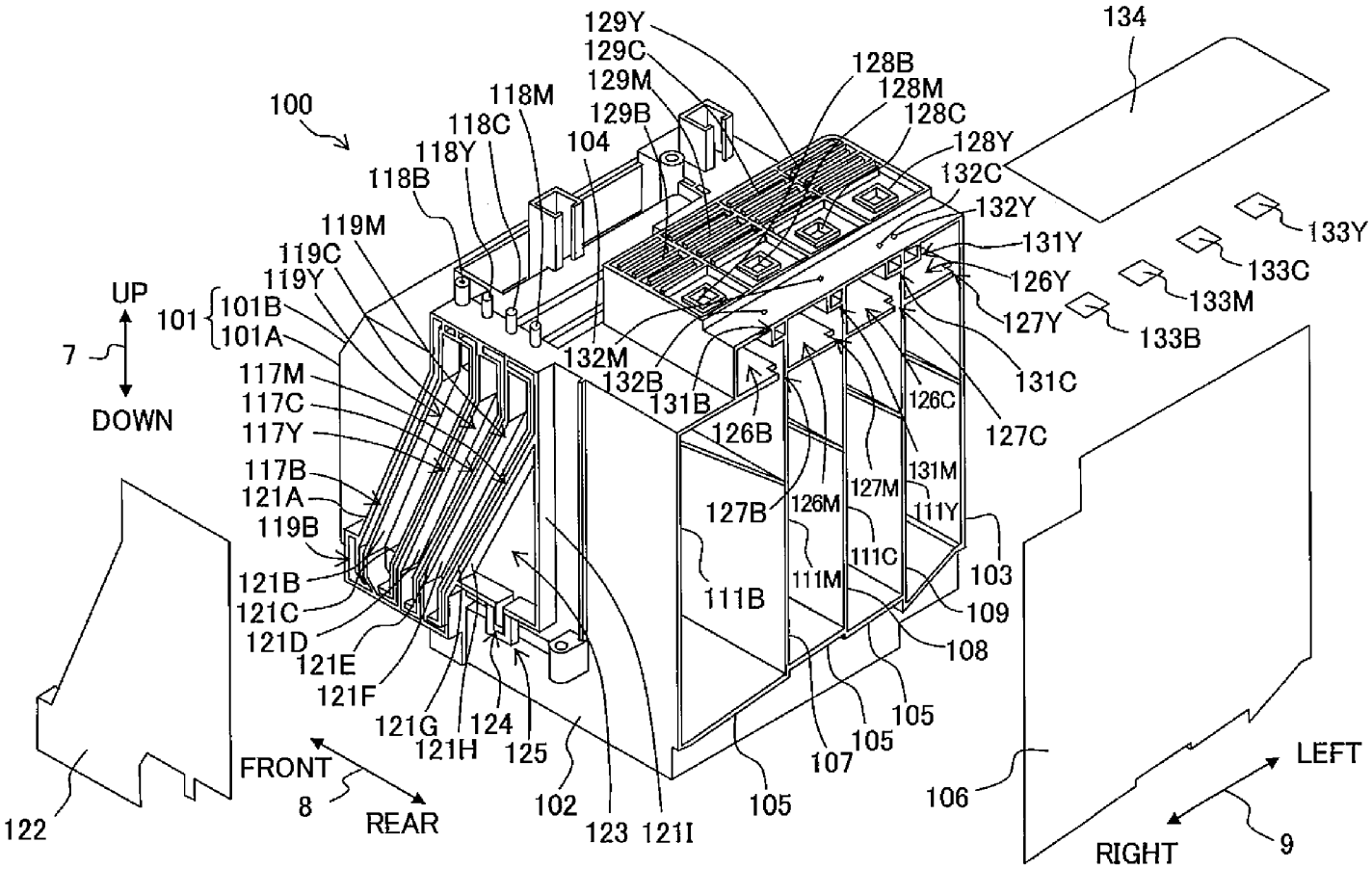
FIG. 5 is a perspective view of the ink tank as viewed from the rear side.

As depicted in FIGS. 4 and 5, the ink tank 100 has a substantially rectangular parallelepiped shape. The ink tank 100 includes a front wall 101, a right wall 102, a left wall 103, an upper wall 104, and a lower wall 105. The front wall 101 is formed of an upstanding wall 101A and an inclined wall 101B. The upstanding wall 101A extends from the lower wall 105 substantially in the up-down direction 7, and the inclined wall 101B slopes in the up-down direction 7 and the front-rear direction 8 so as to be connected to the upper end of the upstanding wall 101A. The upper surface of the lower wall 105 constituting the bottom surfaces of ink chambers 111 as will be described later slopes downward and rightward. The rear surface of the ink tank 100 is open. The rear surface of the ink tank 100 is sealed by welding a film 106 to the rear end surfaces of the right wall 102, the left wall 103, the upper wall 104, and the lower wall 105. That is, the film 106 constitutes the rear wall of the ink tank 100.

<Ink Chambers 111>

As depicted in FIG. 5, partition walls 107, 108, and 109 are provided in the ink tank 100 to divide the interior space of the ink tank 100. Each of the partition walls 107, 108, and 109 extends in the up-down direction 7 and the front-rear direction 8 to be connected to the front wall 101, the upper wall 104, the lower wall 105, and the film 106. Further, the partition walls 107, 108, and 109 are provided separately from each other in the left-right direction 9. Accordingly, the interior space of the ink tank 100 is divided into four ink chambers 111B, 111M, 111C, and 111Y which are adjacent to each other in the left-right direction 9. Each of the ink chambers 111 is an exemplary liquid storage chamber in which the ink to be discharged from the nozzles 40 is stored.

The ink chamber 111B is a space defined by the front wall 101, the right wall 102, the upper wall 104, the lower wall 105, the film 106, and the partition wall 107. The ink chamber 111M is a space defined by the front wall 101, the upper wall 104, the lower wall 105, the film 106, and the partition walls 107, 108. The ink chamber 111C is a space defined by the front wall 101, the upper wall 104, the lower wall 105, the film 106, and the partition walls 108, 109. The ink chamber 111Y is a space defined by the front wall 101, the left wall 103, the upper wall 104, the lower wall 105, the film 106, and the partition wall 109.

In the following, the ink chambers 111B, 111M, 111C, and 111Y will be collectively described as "ink chambers 111" in some cases. Further, components or parts, which are provided for the four ink chambers 111 respectively, will be expressed by using reference numerals which have the same numeral and mutually different suffixes of B, M, C, and Y. When the components or parts are described collectively, the suffixes (B, M, C, and Y) will be omitted in some cases.

Inks having mutually different colors are stored in the ink chambers 111, respectively. Specifically, a black ink is stored in the ink chamber 111B, a cyan ink is stored in the ink chamber 111C, a magenta ink is stored in the ink chamber 111M, and a yellow ink is stored in the ink chamber 111Y. Each of the color inks is an exemplary liquid. However, the number of ink chambers 111 and the colors of inks are not limited to the above examples. The ink chambers 111 are arranged in the left-right direction 9. Of the four ink chambers 111B, 111M, 111C, and 111Y, the ink chamber 111B is disposed on the rightmost side, and the ink chamber 111Y is disposed on the leftmost side. The ink chamber 111B has a capacity larger than those of other ink chambers 111M, 111C, and 111Y.

<Inlets 112>

Inlets 112B, 112M, 112C, and 112Y through which inks are poured into respective ink chambers 111 are arranged in a row in the left-right direction 9 on the inclined wall 101B of the ink tank 100. The inlets 112 penetrate the inclined wall 101B in its thickness direction to allow the ink chambers 111 corresponding thereto respectively to communicate with the outside of the ink tank 100. The inner surface of the inclined wall 101B faces the ink chambers 111, and the outer surface of the inclined wall 101B faces the outside of the ink tank 100. Thus, the inlets 112 allow the ink chambers 111 to directly communicate with the outside of the ink tank 100. In other words, there are no bending channels having cross-sectional areas smaller than respective inlets between the inlets 112 and the ink chambers 111.

As depicted in FIG. 1B, the inclined wall 101B and the inlets 112 provided in the inclined wall 101B are exposed to the outside of the multifunction peripheral 10 through the opening 22 when the cover 70 is in the open position. In this embodiment, the posture of the ink tank 100 (the posture for pouring ink) taken when the ink(s) is(are) poured into the ink chamber(s) 111 through the inlet(s) 112 is coincident with the posture of the ink tank 100 taken when the multifunction peripheral 10 is in the usable posture. That is, the ink(s) is(are) poured into the ink chamber(s) 111 through the inlet(s) 112 when the multifunction peripheral 10 takes the usable posture.

The inlets 112 are formed in the inclined wall 101B of the ink tank 100 to face outward of the housing 14 and obliquely upward. In other words, a virtual plane including the inlets 112 is along the inclined wall 101B and is inclined in the up-down direction 7 and the front-rear direction 8. A direction, which is orthogonal to the virtual plane and is directed from the inlets 112 to the outside of the ink tank 100, extends obliquely upward from the virtual plane.

The ink tank 100 includes caps 113B, 113M, 113C, and 113Y which are attachable/detachable with respect to respective inlets 112. As depicted in FIG. 1A, the caps 113 attached to the inlets 112 are brought in tight contact with the peripheries of the inlets 112 to cover the inlets 112. Meanwhile, as depicted in FIG. 1B, the caps 113 detached from the inlets 112 open the inlets 112. The caps 113 are attached/detached with respect to the inlets 112 in a state that the cover 70 is in the open position. Ink(s) can be poured into the ink chamber(s) 111 by removing the cap(s) 113 from the inlet(s) 112.

<Ink Flow Channels 114>

As depicted in FIGS. 6 to 9A, ink flow channels 114B, 114M, 114C, and 114Y (exemplary liquid flow channels) are connected to the ink chambers 111 corresponding thereto respectively. The inks stored in the ink chambers 111 flow to the outside of the ink tank 100 through the ink flow channels 114 corresponding thereto respectively. The ink flow channels 114 in this embodiment extend from the ink chambers 111 corresponding thereto respectively to reach the right lateral surface of the ink tank 100 (i.e., the outer surface of the right wall 102).

Figure 7:
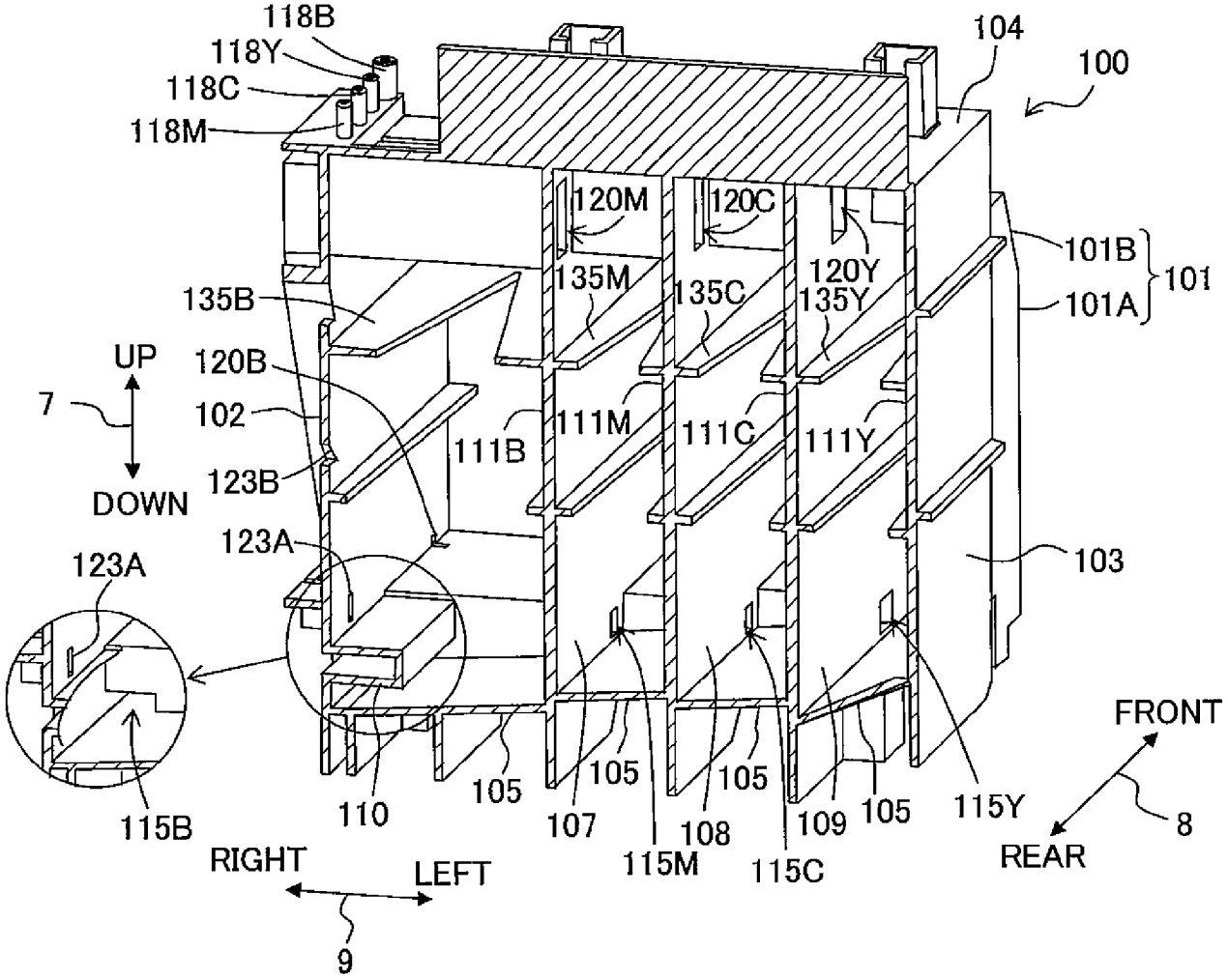
FIG. 7 is a cross-sectional perspective view taken along the line VII-VII in FIG. 4.
Figure 8:
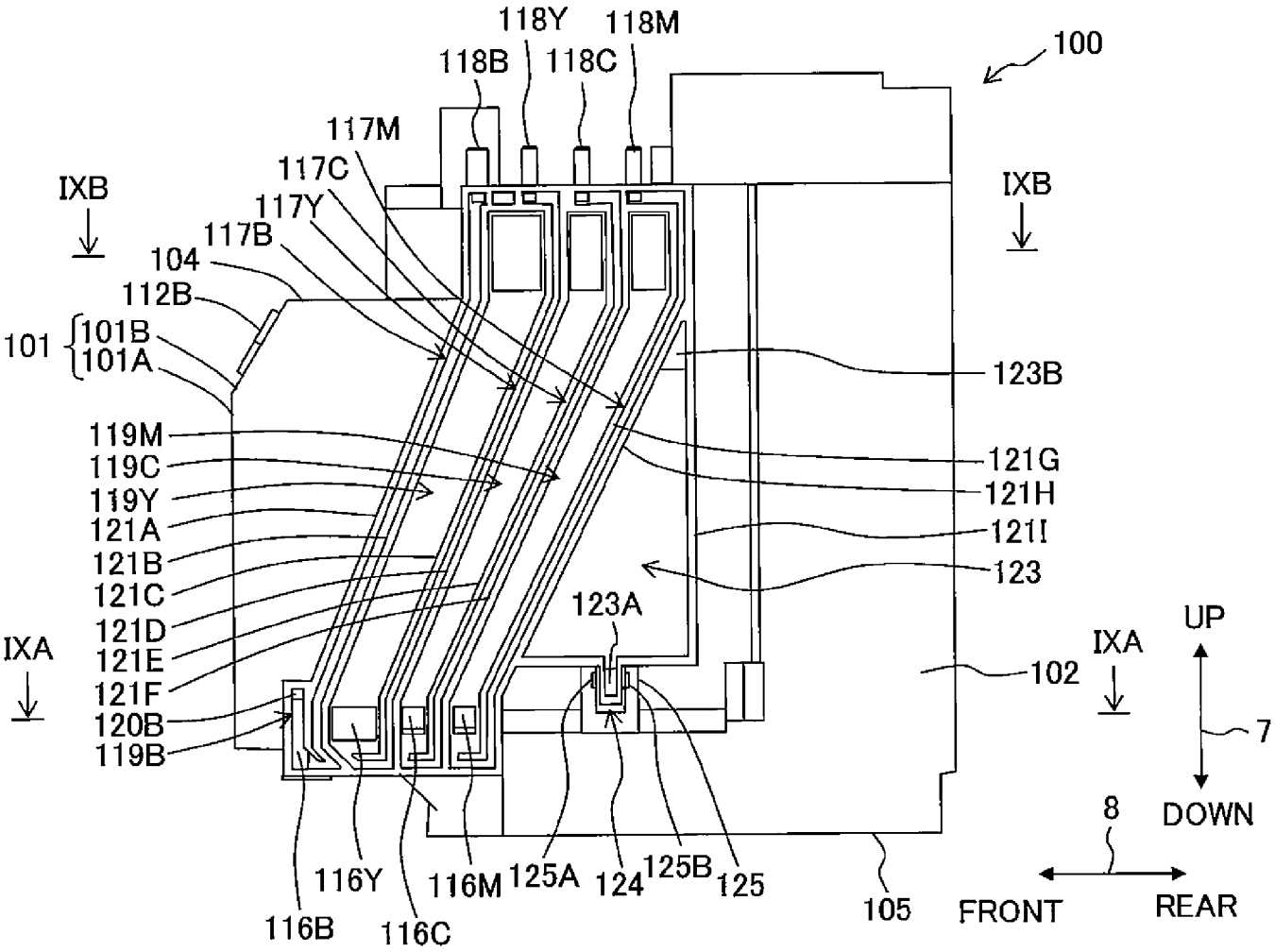
FIG. 8 is a right-side view of the ink tank.
Figure 9A:
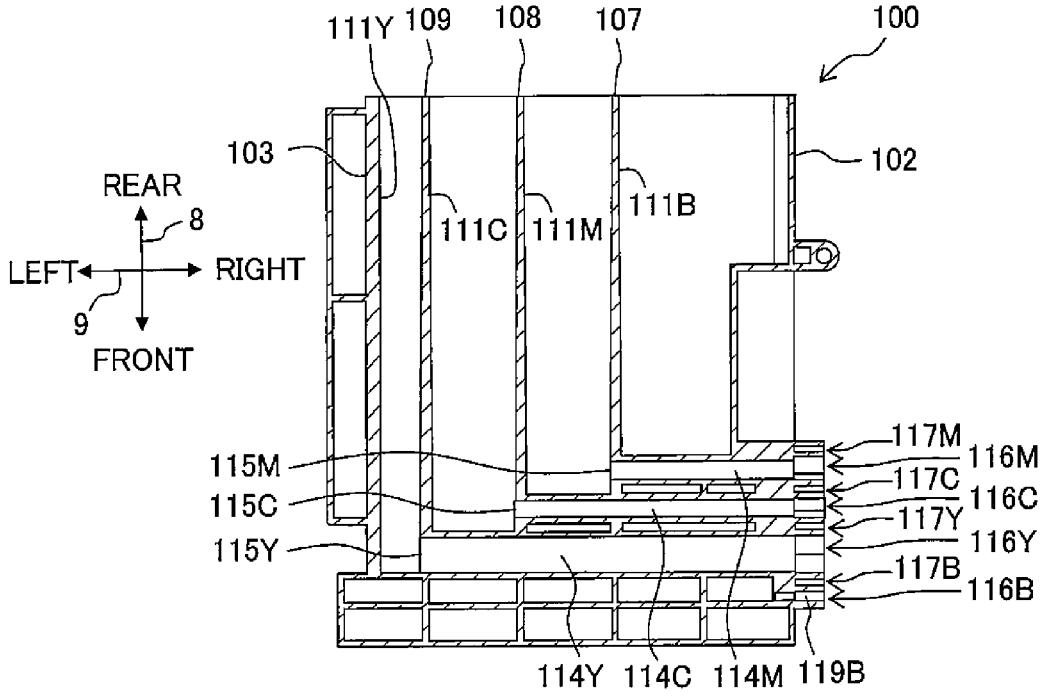
FIG. 9A is a cross-sectional view taken along the line IXA-IXA in FIG. 8.

As depicted in FIGS. 7 and 9A, the ink flow channel 114Y communicates with the ink chamber 111Y through an opening 115Y, which is provided near the lower end of the partition wall 109 defining the right surface of the ink chamber 111Y. As depicted in FIG. 8, the ink flow channel 114Y reaches the right lateral surface of the ink tank 100 through an opening 116Y provided in the right wall 102. More specifically, as depicted in FIG. 9A, the ink flow channel 114Y is formed on the front side of the ink chambers 111B, 111M, and 111C so that the ink flow channel 114Y extends rightward from the opening 115Y in the left-right direction 9, penetrates the right wall 102, and reaches the opening 116Y (i.e. the right lateral surface of the ink tank 100).

As depicted in FIGS. 7 and 9A, the ink flow channel 114C communicates with the ink chamber 111C through an opening 115C, which is provided near the lower end of the partition wall 108 defining the right surface of the ink chamber 111C. As depicted in FIG. 8, the ink flow channel 114C reaches the right lateral surface of the ink tank 100 through an opening 116C provided in the right wall 102. More specifically, as depicted in FIG. 9A, the ink flow channel 114C is formed on the front side of the ink chambers 111B and 111M so that the ink flow channel 114C extends rightward from the opening 115C in the left-right direction 9, penetrates the right wall 102, and reaches the opening 116C.

As depicted in FIGS. 7 and 9A, the ink flow channel 114M communicates with the ink chamber 111M through an opening 115M, which is provided near the lower end of the partition wall 107 defining the right surface of the ink chamber 111M. As depicted in FIG. 8, the ink flow channel 114M reaches the right lateral surface of the ink tank 100 through an opening 116M provided in the right wall 102. More specifically, as depicted in FIG. 9A, the ink flow channel 114M is formed on the front side of the ink chamber 111B so that the ink flow channel 114M extends rightward from the opening 115M in the left-right direction 9, penetrates the right wall 102, and reaches the opening 116M.

Figure 6:
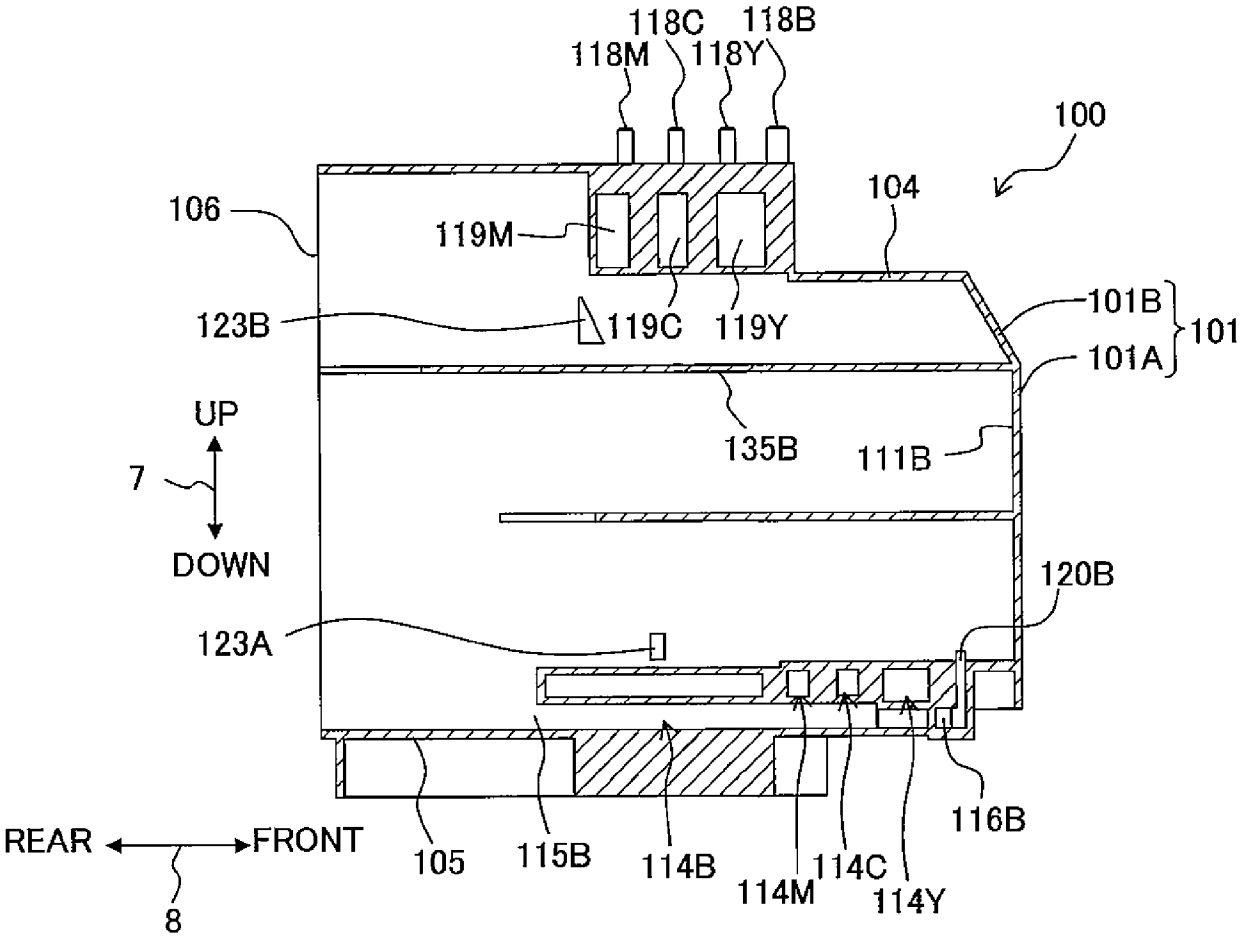
FIG. 6 is a cross-sectional view taken along the line VI-VI in FIG. 4.

As depicted in FIGS. 6 and 7, the ink flow channel 114B communicates with the ink chamber 111B through an opening 115B, which is provided near the boundary between the lower wall 105 defining the bottom surface of the ink chamber 111B and the right wall 102 defining the right surface of the ink chamber 111B. A partition wall 110 is provided above the opening 115B to intersect with the direction in which the ink flows to the opening 115B (i.e. downward direction in the up-down direction 7). As depicted in FIG. 8, the ink flow channel 114B reaches the right lateral surface of the ink tank 100 through an opening 116B provided in the right wall 102.

As depicted in FIG. 6, the ink flow channel 114B extends frontward from the opening 115B in the front-rear direction 8, penetrates the right wall 102 at the front side of the ink flow channels 114M, 114C, and 114Y, and reaches the opening 116B. The ink flow channel 114B extending in the front-rear direction 8 intersects with the ink flow channels 114M, 114C, and 114Y extending in the left-right direction 9. More specifically, the ink flow channel 114B extends frontward on the lower side of the ink flow channels 114M, 114C, and 114Y extending in the left-right direction 9.

That is, the openings 115B, 115M, 115C, and 115Y connect the ink chambers 111B, 111M, 111C, and 111Y and the ink flow channels 114B, 114M, 114C, and 114Y, respectively; and, as depicted in FIG. 7, the openings 115B, 115M, 115C, and 115Y are provided to be positioned on the lower side, of the centers of the ink chambers 111B, 111M, 111C, and 111Y, in the up-down direction 7, the front side, of the centers of the ink chambers 111B, 111M, 111C, and 111Y, in the front-rear direction 8, and the right side, of the centers of the ink chambers 111B, 111M, 111C, and 111Y, in the left-right direction 9. As depicted in FIG. 8, the openings 116B, 116M, 116C, and 116Y are provided, in the right lateral surface of the ink tank 100, to be positioned on the lower side and the front side, of the center of the ink tank 100, in the up-down direction 7 and the front-rear direction 8 respectively. More specifically, the openings 116 are provided in the right lateral surface of the ink tank 100, in the order of openings 116B, 116Y, 116C and 116M from the front side to the rear side in the front-rear direction 8, to be adjacent to each other in the front-rear direction 8.

The center of the ink chamber 111 in the up-down direction 7 means the center of the maximum dimension of the ink chamber 111 in the up-down direction 7. In this embodiment, the maximum dimension of the ink chamber 111 in the up-down direction 7 means the maximum dimension between the upper wall 104 and the lower wall 105 in the up-down direction 7. The center of the ink chamber 111 in the front-rear direction 8 means the center of the maximum dimension of the ink chamber 111 in the front-rear direction 8. In this embodiment, the maximum dimension of the ink chamber 111 in the front-rear direction 8 means the maximum dimension between the front wall 101 and the film 106 in the front-rear direction 8. The center of the ink chamber 111 in the left-right direction 9 means the center of the maximum dimension of the ink chamber 111 in the left-right direction 9. In this embodiment, the maximum dimension of the ink chamber 111 in the left-right direction 9 means the maximum dimension between the partition walls 107 and 108 provided adjacently to each other in the left-right direction 9, the maximum dimension between the partition walls 108 and 109 provided adjacently to each other in the left-right direction 9, the maximum dimension between the partition wall 107 and the right wall 102 in the left-right direction 9, and the maximum dimension between the partition wall 109 and the left wall 103 in the left-right direction 9. Similarly, the center of the ink tank 100 in the up-down direction 7 means the center of the maximum dimension of the ink tank 100 in the up-down direction 7. The center of the ink tank 100 in the front-rear direction 8 means the center of the maximum dimension of the ink tank 100 in the front-rear direction 8.

The ink flow channels 114 ranging from the openings 115 to the openings 116 have mutually different volumes. In this embodiment, the ink flow channel 114Y ranging from the opening 115Y to the opening 116Y has the largest volume, the ink flow channel 114C ranging from the opening 115C to the opening 116C has the second largest volume, the ink flow channel 114M ranging from the opening 115M to the opening 116M has the third largest volume, and the ink flow channel 114B ranging from the opening 115B to the opening 116B has the smallest volume. The ink flow channels 114 have mutually different volumes for various reasons such as the difference between the lengths of the ink flow channels 114 in the left-right direction 9 and the difference between the cross-sectional areas, of the ink flow channels 114, orthogonal to the left-right direction 9.

The maximum flow amount of the ink flowing from each ink flow channel 114 per unit time is set to be larger than the maximum discharge amount of the ink discharged from the nozzles 40 of the recording head 39 per unit time. The maximum flow amount is determined, for example, by the cross-sectional area, of each ink flow channel 114, orthogonal to the left-right direction 9.

<Ink Lead-Out Channels 117>

As depicted in FIG. 8, ink lead-out channels 117B, 117M, 117C, and 117Y (exemplary liquid lead-out channels) are provided in the right lateral surface of the ink tank 100. One ends of the ink lead-out channels 117B, 117M, 117C, and 117Y are connected to the ink flow channels 114B, 114M, 114C, and 114Y at the positions of the openings 116B, 116M, 116C, and 116Y respectively, and the other ends of the ink lead-out channels 117B, 117M, 117C, and 117Y are connected to connection parts 118B, 118M, 118C, and 118Y respectively. The protruding connection parts 118B, 118M, 118C, and 118Y formed on the upper wall 104 of the ink tank 100 are connected to four ink tubes 32B, 32M, 32C, and 32Y (see FIG. 3) respectively. That is, the inks flowing from the ink chambers 111 through the ink flow channels 114 are led to the recording head 39 through the ink lead-out channels 117 and the ink tubes 32 connected to the connection parts 118, respectively. The ink lead-out channels 117 and the ink tubes 32 have substantially the same volume.

<Return Channels 119>

Figure 9B:
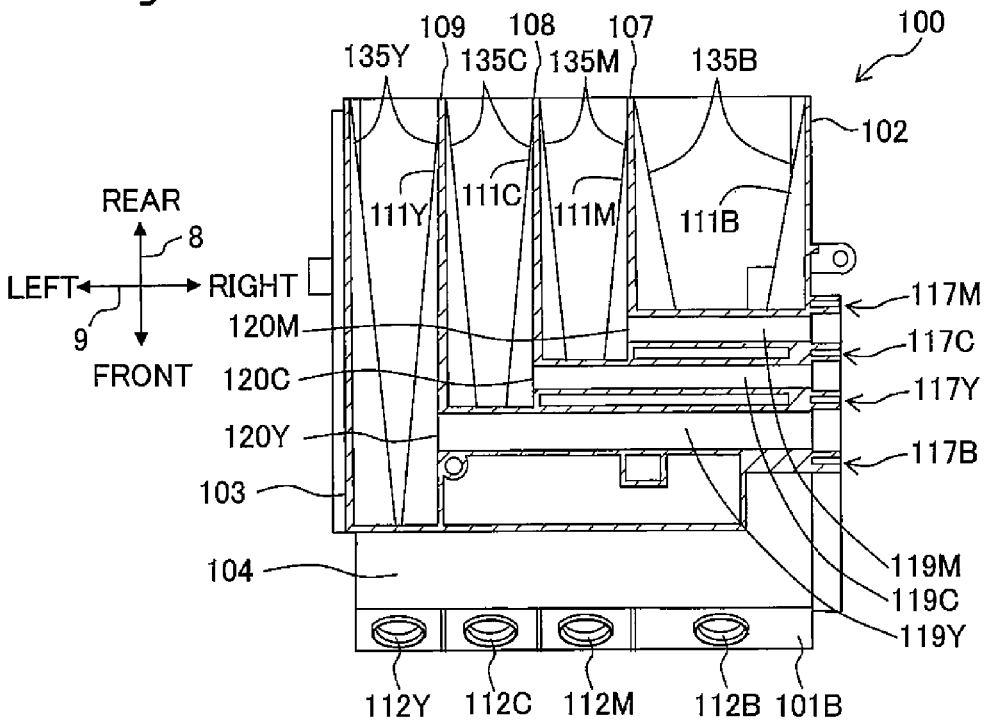
FIG. 9B is a cross-sectional view taken along the line IXB-IXB in FIG. 8.

As depicted in FIG. 8 and FIG. 9B, return channels 119B, 119M, 119C, and 119Y are provided in the right lateral surface of the ink tank 100. One ends of the return channels 119B, 119M, 119C, and 119Y are connected to the ink flow channels 114B, 114M, 114C, and 114Y at the positions of the openings 116B, 116M, 116C, and 116Y respectively, and the other ends of the return channels 119B, 119M, 119C, and 119Y communicate with the ink chambers 111B, 111M, 111C, and 111Y through openings 120B, 120M, 120C, and 120Y respectively. The openings 116 and 120 are provided at mutually different positions in the up-down direction 7. More specifically, the openings 120 are provided above the openings 116 corresponding thereto respectively in the up-down direction 7.

The openings 120 are provided above the centers of the ink chambers 111 corresponding thereto respectively in the up-down direction 7 (except for the opening 120B). More preferably, the openings 120 are provided above the liquid surfaces of inks in the ink chambers 111 corresponding thereto respectively (except for the opening 120B). The openings 120 are provided on the rear side (an exemplary third direction) of the openings 116 corresponding thereto respectively in the front-rear direction 8 (except for the opening 120B). The openings 120 are provided on the left side (an exemplary fourth direction) of the openings 116 corresponding thereto respectively in the left-right direction 9. That is, the return channels 119 extend upward in the up-down direction 7 and rearward in the front-rear direction 8 from the openings 116 corresponding thereto respectively, further extend leftward in the left-right direction 9, and reach the openings 120 corresponding thereto respectively (except for the return channel 119B).

As depicted in FIG. 8, a plurality of projecting walls 121A to 121I are provided in the right wall 102 of the ink tank 100. The projecting walls 121A to 121I will be described collectively as "projecting walls 121" in some cases. The projecting walls 121 project rightward from the outer surface (right lateral surface) of the right wall 102 to extend along the outer surface of the right wall 102. A film 122 is welded to the front end on the right side of each projecting wall 121. In this embodiment, a single (common) film 122 is welded to the projecting walls 121A to 121I. The ink lead-out channels 117 and the return channels 119 are spaces which are defined or divided by the adjacent projecting walls 121A to 121H and the film 122.

The projecting walls 121A, 121B defining the ink lead-out channel 117B extend rearward from the position where the opening 116B is sandwiched by the projecting walls 121A, 121B, further extend upward, and reach the upper end of the ink tank 100. The projecting walls 121C, 121D defining the ink lead-out channel 117Y, the projecting walls 121E, 121F defining the ink lead-out channel 117C, and the projecting walls 121G, 121H defining the ink lead-out channel 117M extend downward from the positions where the openings 116Y, 116C, and 116M are sandwiched by the projecting walls corresponding thereto respectively, further extend upward on the rear side of the openings 116Y, 116C, and 116M, and reach the upper end of the ink tank 100, respectively. That is, the ink lead-out channels 117Y, 117C, and 117M are connected to the ink flow channels 114Y, 114C, and 114M at the lower parts of the openings 116Y, 116C, and 116M, respectively. The lower parts of the openings 116Y, 116C, and 116M mean the parts positioned below the centers of the openings 116Y, 116C, and 116M in the up-down direction 7. Further, the ink lead-out channels 117 are connected to the connection parts 118 corresponding thereto respectively through spaces (not depicted) extending in the up-down direction 7 and the left-right direction 9 in the ink tank 100.

The protruding walls 121A, 121B defining the return channel 119B, the protruding walls 121B, 121C defining the return channel 119Y, the projecting walls 121D, 121E defining the return channel 119C, and the projecting walls 121F, 121G defining the return channel 119M respectively extend upward from the positions where the openings 116B, 116Y, 116C, and 116M are sandwiched by the protruding walls 121 corresponding thereto respectively. That is, the return channels 119 are connected to the ink flow channels 114 at the upper parts of the openings 116, respectively. The upper parts of the openings 116 mean the parts positioned above the centers of the openings 116 in the up-down direction 7. As depicted in FIG. 9B, the return channels 119 extend leftward in the left-right direction 9 in the ink tank 100 to communicate with the ink chambers 111 through the openings 120, respectively.

In this embodiment, the channel resistance of the return channels 119Y, 119C, and 119M is set to be larger than the channel resistance of the ink flow channels 114Y, 114C, and 114M, respectively. There are various ways or methods for varying the channel resistance. For example, the channel resistance can be increased by lengthening the channel length, reducing the cross-sectional area of the channel, or combining them.

<Additional Ink Chamber 123>

As depicted in FIG. 8, an additional ink chamber 123 (an exemplary additional storage chamber) is provided in the right lateral surface of the ink tank 100. The additional ink chamber 123 is a space defined by the film 122 and the projecting walls 121H, 121I which are formed continuously in the circumference direction. The additional ink chamber 123 communicates with the ink chamber 111B through through-holes 123A, 123B penetrating the right wall 102. The through hole 123B is provided above the through hole 123A in the up-down direction 7. The additional ink chamber 123 includes a detection target part 124, which is formed by surrounding the front, rear, and lower parts of through hole 123A with a part of the projecting wall 1211 defining the lower end of the additional ink chamber 123.

<Optical Sensor 125>

As depicted in FIGS. 4 and 8, the multifunction peripheral 10 includes an optical sensor 125 having a light emitting part 125A and a light receiving part 125B disposed to face each other across the detection target part 124 in the front-rear direction 8. The light emitting part 125A outputs the light, which transmits the projecting wall 1211 and does not transmit the black ink (e.g. visible light and infrared light), toward the light receiving part 125B. When the light receiving part 125B receives the light outputted from the light emitting part 125A, the light receiving part 125B outputs a high level signal to the controller. The high level signal means a signal of which signal level is not less than a threshold value. When the light receiving part 125B receives no light, the light receiving part 125B outputs a low level signal to the controller. The low level signal means a signal of which signal level is less than the threshold value.

<Atmosphere Communication Paths 126>

Figure 10B:
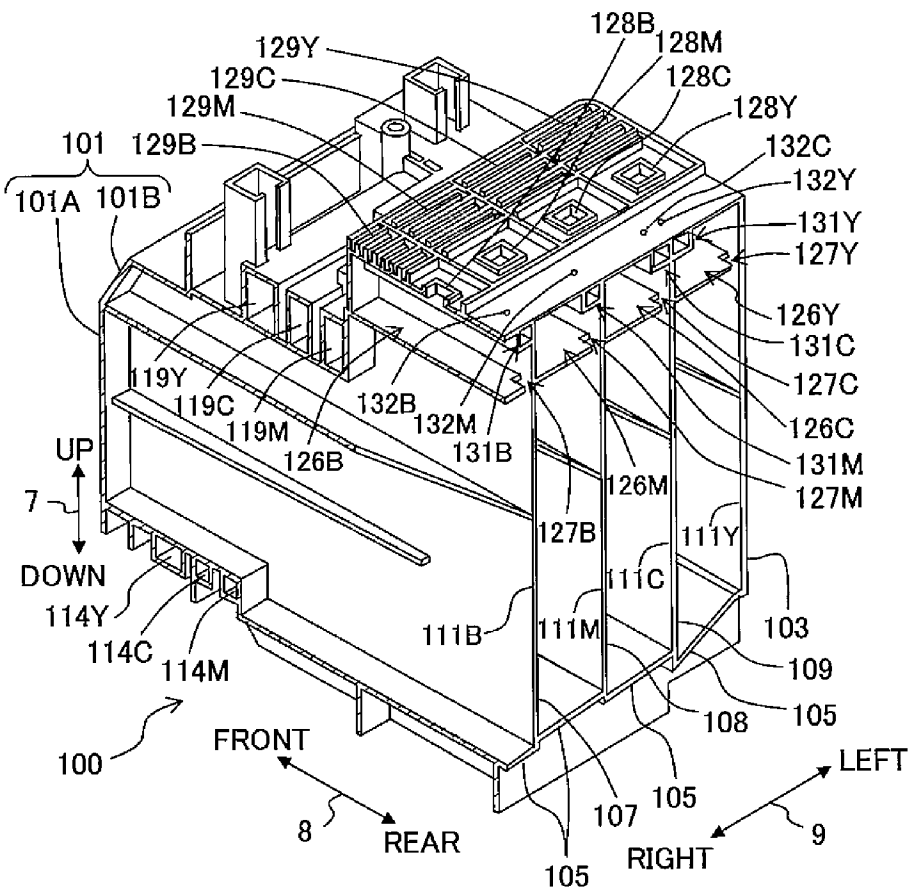
FIG. 10B is a cross-sectional perspective view taken along the line XB-XB in FIG. 10A.
Figure 10A:
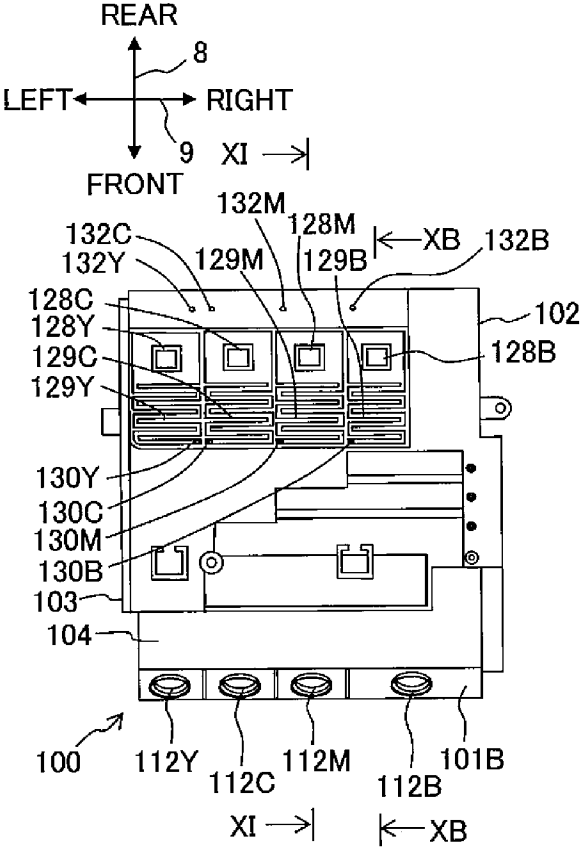
FIG. 10A is a plan view of the ink tank.

As depicted in FIG. 10B, atmosphere communication paths 126B, 126M, 126C, and 126Y are connected to the ink chambers 111, respectively. The atmosphere communication paths 126 allow the ink chambers 111 corresponding thereto respectively to communicate with the atmosphere. More specifically, the atmosphere communication paths 126 communicate with the ink chambers 111 through notches 127 respectively, and communicate with the outside of the ink tank 100 through openings 132 respectively. In the atmosphere communication paths 126, the atmosphere flows between the ink chambers 111 and the outside of the ink tank 100 through the notches 127, first through holes 128, labyrinths 129, second through holes 130, atmosphere channels 131, and the openings 132.

The notches 127 are provided to be positioned on the upper side, of the centers of the ink chambers 111 corresponding thereto respectively, in the up-down direction 7, the rear side, of the centers of the ink chambers 111 corresponding thereto respectively, in the front-rear direction 8, and the left side, of the centers of the ink chambers 111 corresponding thereto respectively, in the left-right direction 9. More specifically, the notch 127B is defined by the upper wall 104, the film 106, and the partition wall 107. The notch 127M is defined by the upper wall 104, the film 106, and the partition wall 108. The notch 127C is defined by the upper wall 104, the film 106, and the partition wall 109. The notch 127Y is defined by the upper wall 104, the film 106, and the left wall 103. That is, in this embodiment, each of the notches 127 is provided at the upper, rear, left end of one of the ink chambers 111.

Semipermeable films 133 are affixed to the first through holes 128. The semipermeable films 133 are porous films having minute holes which block the passage of the ink and allow the passage of the atmosphere. For example, it is possible to use, as the semipermeable films 133, porous films made of fluororesin such as polytetrafluoroethylene, polychlorotrifluoroethylene, tetrafluoroethylene-hexafluoropropylene copolymer, tetrafluoroethylene-perfluoro alkyl vinyl ether copolymer, and tetrafluoroethylene-ethylene copolymer. The upper parts of the first through holes 128, the labyrinths 129, the second through holes 130 are covered with a film 134.

<Partition Walls 135>

As depicted in FIGS. 7 and 9B, partition walls 135B, 135M, 135C, and 135Y extending in the front-rear direction 8 and the left-right direction 9 are provided in the ink chambers 111, respectively. In this embodiment, the partition walls 135 extend in a substantially horizontal direction, but the extending direction of the partition walls 135 is not limited to this. For example, the partition walls 135 may incline downward in the up-down direction 7 and rearward in the front-rear direction 8.

The partition wall 135B is connected to the upstanding wall 101A, the right wall 102, the film 106, and the partition wall 107. The partition wall 135M is connected to the upstanding wall 101A, the film 106, and the partition walls 107, 108. The partition wall 135C is connected to the upstanding wall 101A, the film 106, and the partition walls 108, 109. The partition wall 135Y is connected to the upstanding wall 101A, the left wall 103, the film 106, and the partition wall 109. That is, the partition walls 135 are provided below the inlets 112 in the ink chambers 111, respectively. The partition wall 135 partitions a part of the ink chamber 111 in the up-down direction 7. That is, the partition walls 135 are separated from the upper wall 104 and the lower wall 105 so that spaces are provided above and below the partition walls 135 in the up-down direction 7. The partition walls 135B, 135M, 135C, and 135Y have substantially the same shape, and thus an explanation will be made in detail about the partition wall 135M while referring to FIGS. 11 and 12.

Figure 11:
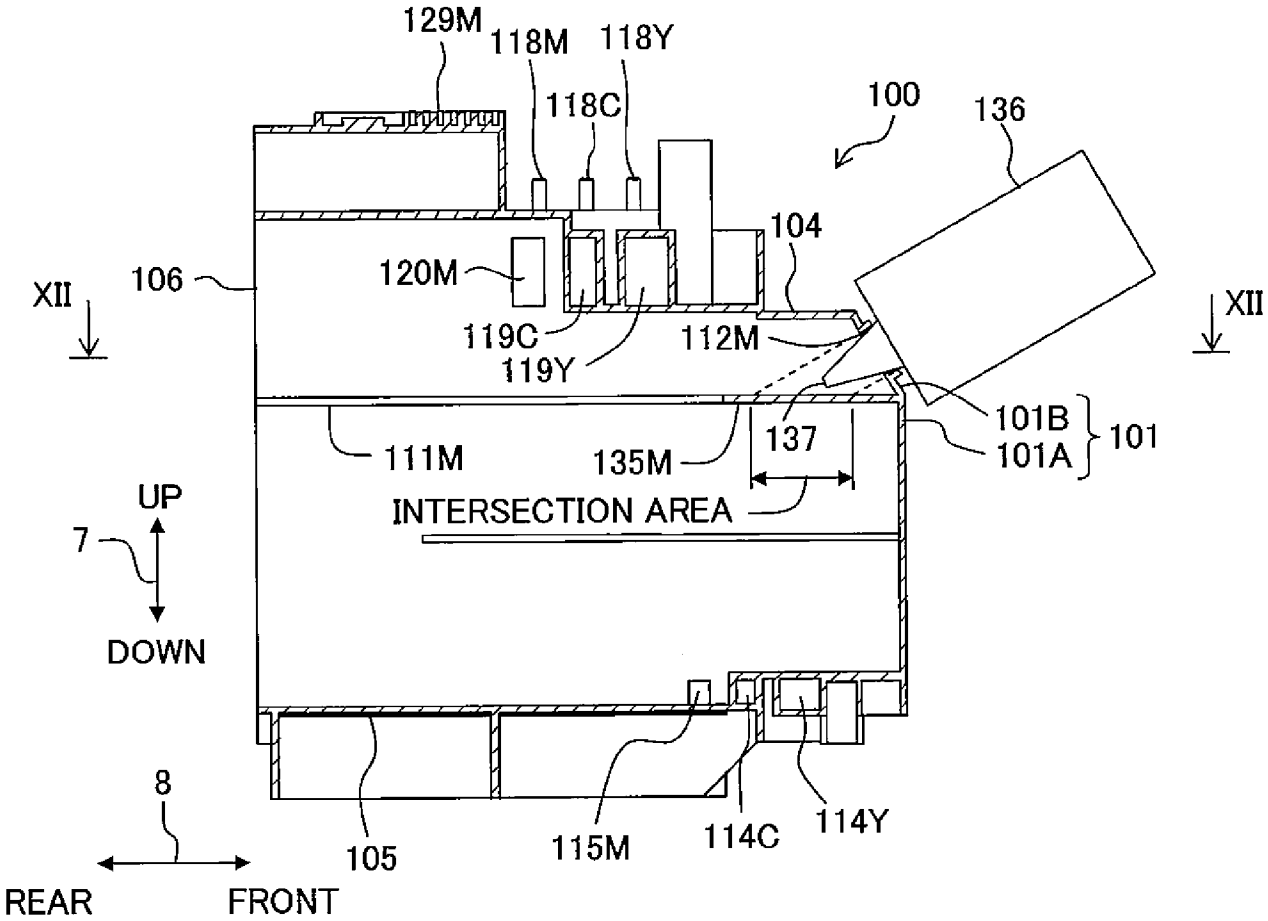
FIG. 11 is a cross-sectional view taken along the line XI-XI in FIG. 10A.

As depicted in FIG. 11, at least a part of the partition wall 135M is in an intersection area. As an example, the intersection area can be defined as an area which intersects with a virtual line (dotted lines in FIG. 11) passing the inlet 112M and being orthogonal to the inclined wall 101B. As another example, the intersection area can be defined as an area which intersects with a virtual line passing the inlet 112M and extending in the direction through which the inlet 112M penetrates. As still another example, the intersection area can be defined as an area which intersects with the flow direction of ink flowing from a supply port 137 of an ink bottle 136. The supply port 137 enters the ink chamber 111M through the inlet 112M and the ink bottle 136 is positioned at an ink supply position. That is, the partition wall 135M is in an area where the ink flowing into the ink chamber 111M through the inlet 112M passes. In other words, most of the ink poured into the ink chamber 111M through the inlet 112M hits the partition wall 135M.

Figure 12:
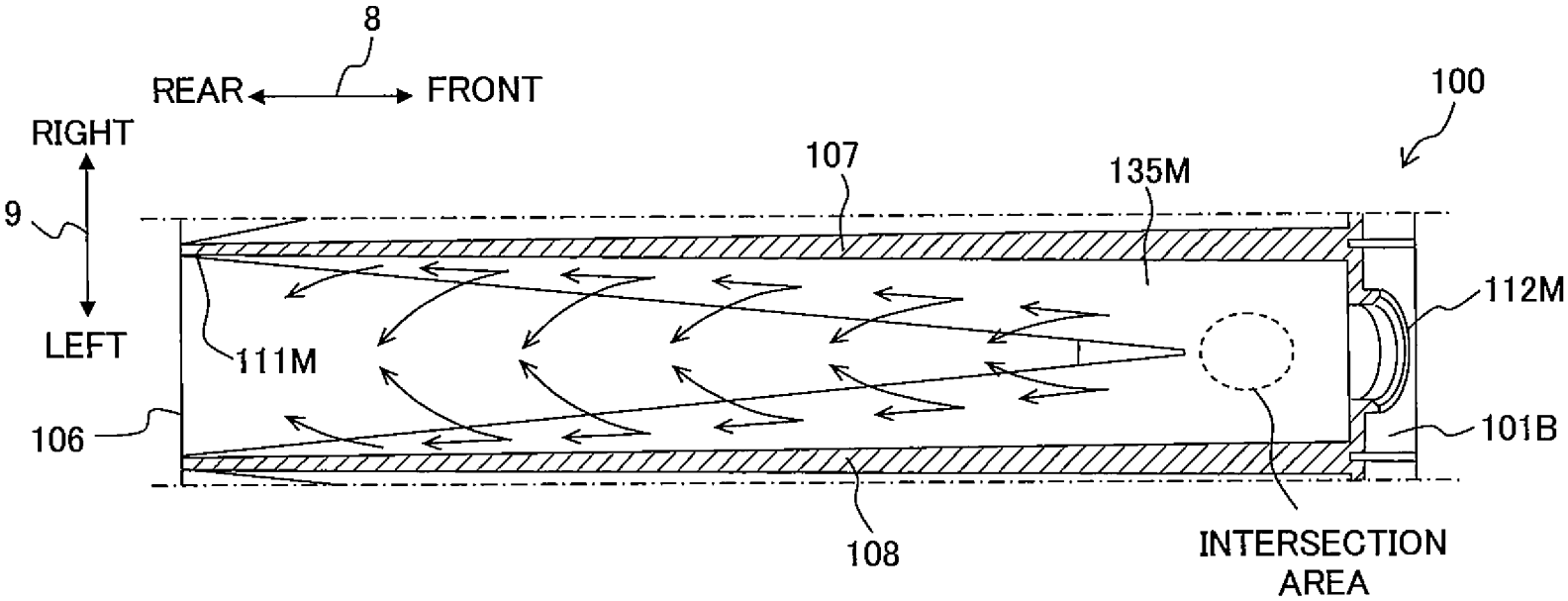
FIG. 12 is a cross-sectional view taken along the line XII-XII in FIG. 11.

As depicted in FIG. 12, the partition wall 135M is provided throughout the front side in the front-rear direction 8 of the intersection area. That is, the partition wall 135M is provided throughout the side close to the inlet 112M in the horizontal direction. In other words, the partition wall 135M is continuously formed to be connected to the upstanding wall 101A and the partition walls 107, 108 without any space therebetween on the front side of the intersection area. That is, the partition wall 135M partitions, in the up-down direction 7, the entire area of the ink chamber 111M on the front side of the intersection area. Further, the partition wall 135M extends to the rear side in the front-rear direction 8 of the intersection area (i.e. the side far from the inlet 112M in the horizontal direction). However, a part of the partition wall 135M on the rear side of the intersection area is formed to have an opening. The opening is formed in the partition wall 135M such that an area of the opening (the opening width in the left-right direction 9 in the example of FIG. 12) is larger, as the opening is farther away from the inlet 112M. The shape of the opening is symmetrical in a direction farther away from the inlet 112M along the partition wall 135M (i.e. rearward in the front-rear direction 8). In this embodiment, the shape of the opening is an isosceles triangle, of which top faces frontward.

<Caps 113>

As depicted in FIGS. 1A and 1B, the caps 113 are attachable/detachable with respect to the inlets 112 of the ink tank 100. Four caps 113B, 113M, 113C, and 113Y are provided corresponding to four inlets 112B, 112M, 112C, and 112Y of the ink tank 100. The caps 113B, 113M, 113C, and 113Y have the same shape. Thus, in the following, the caps 113B, 113M, 113C, and 113Y will be represented as "cap 113" and an explanation will be made in detail about the cap 113.

Figure 13A:
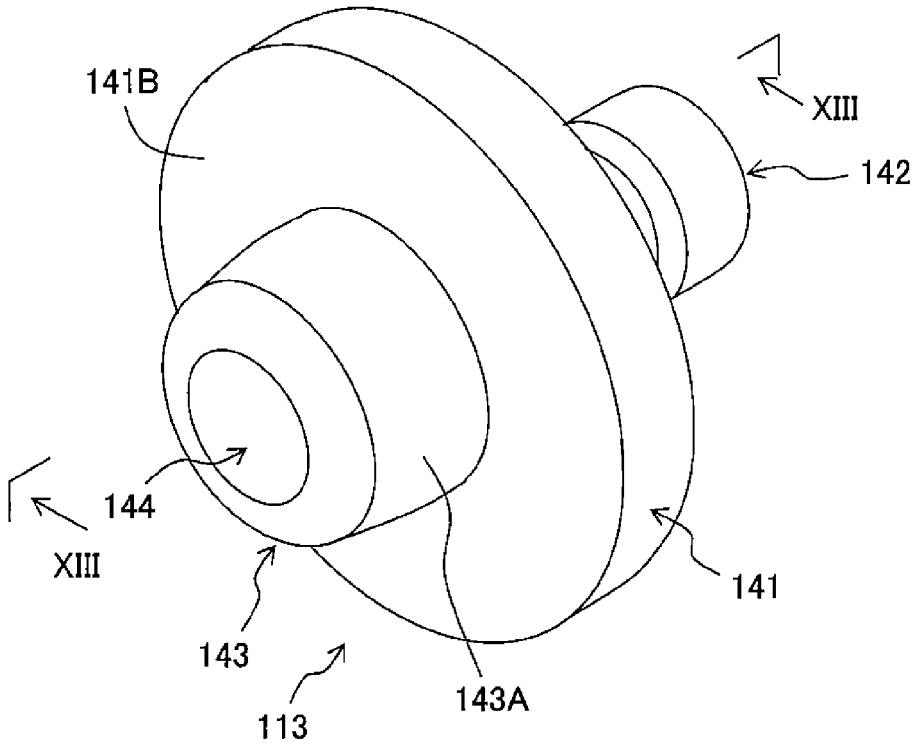
FIG. 13A is a perspective view of the outer appearance of a cap.
Figure 13B:
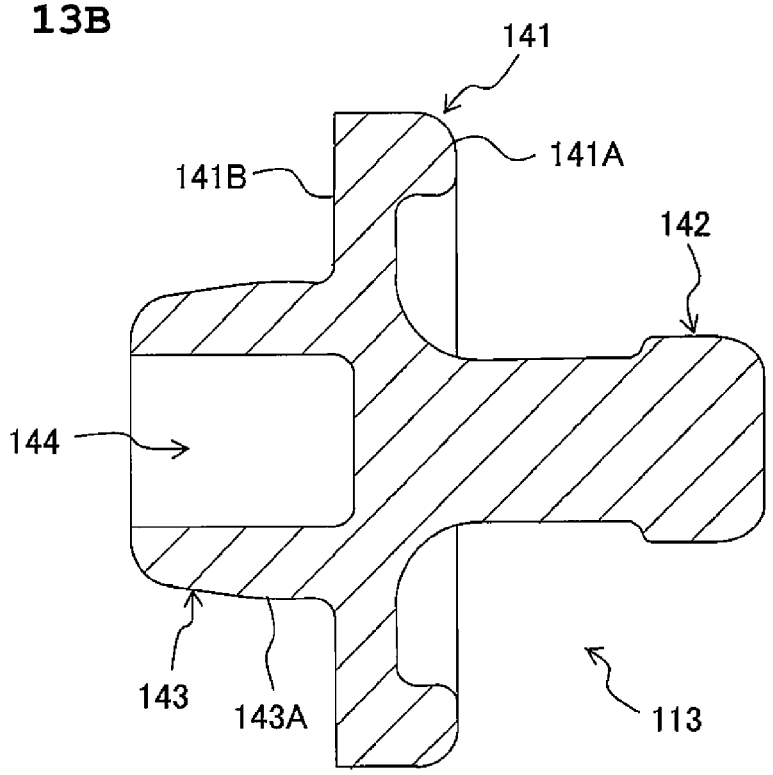
FIG. 13B is a cross-sectional view of the cap.

As depicted in FIGS. 13A and 13B, the cap 113 includes a disk 141 having a substantially disk shape, a knob part 142, and a convex part 143. The knob part 142 and the convex part 143 project in opposite directions from the center of the disk 141. The cap 113 is made of elastic deformable material such as rubber and elastomer. The disk 141 has a surface 141A in which the vicinity of the center is recessed. The knob part 142 projects from the center of the surface 141A in the direction orthogonal to the surface 141A. The recess in the surface 141A is formed to lengthen the knob part 142 in a longitudinal direction, thereby making it easy to hold the knob part 142. A back surface 141B is a flat surface. The back surface 141B can make contact with the periphery of the inlet 112.

The knob part 142 has a substantially cylindrical shape. The outer diameter of the front end of the knob part 142 is greater than the outer diameter of the base end (the part at the side of the surface 141A) of the knob part 142. This is because the front end having a larger outer diameter allows the fingers of a user to easily access the knob part 142 when the user holds and pulls the cap 113 out of the inlet 112.

The convex part 143 has a substantially cylindrical shape. The convex part 143 projects from the center of the back surface 141B of the disk 141 in the direction orthogonal to the back surface 141B. The outer diameter of the convex part 143 is slightly greater than the inner diameter of the inlet 112. Therefore, the convex part 143 is inserted into the inlet 112 while being elastically deformed to reduce the outer diameter. In a state that the convex part 143 is inserted into the inlet 112, an outer surface 143A of the convex part 143 is brought in contact under pressure with the inner surface of the inlet 112 to seal the inlet 112 so that no liquid leaks therefrom. A concave part 144, which is recessed toward the back surface 141B, is formed at the center of the front end of the convex part 143. The concave part 144 allows the outer surface 143A of the convex part 143 to easily fall toward the inside in a radial direction. This makes it easy to insert the convex part 143 into the inlet 112.

<Cover 70>

Figure 16:
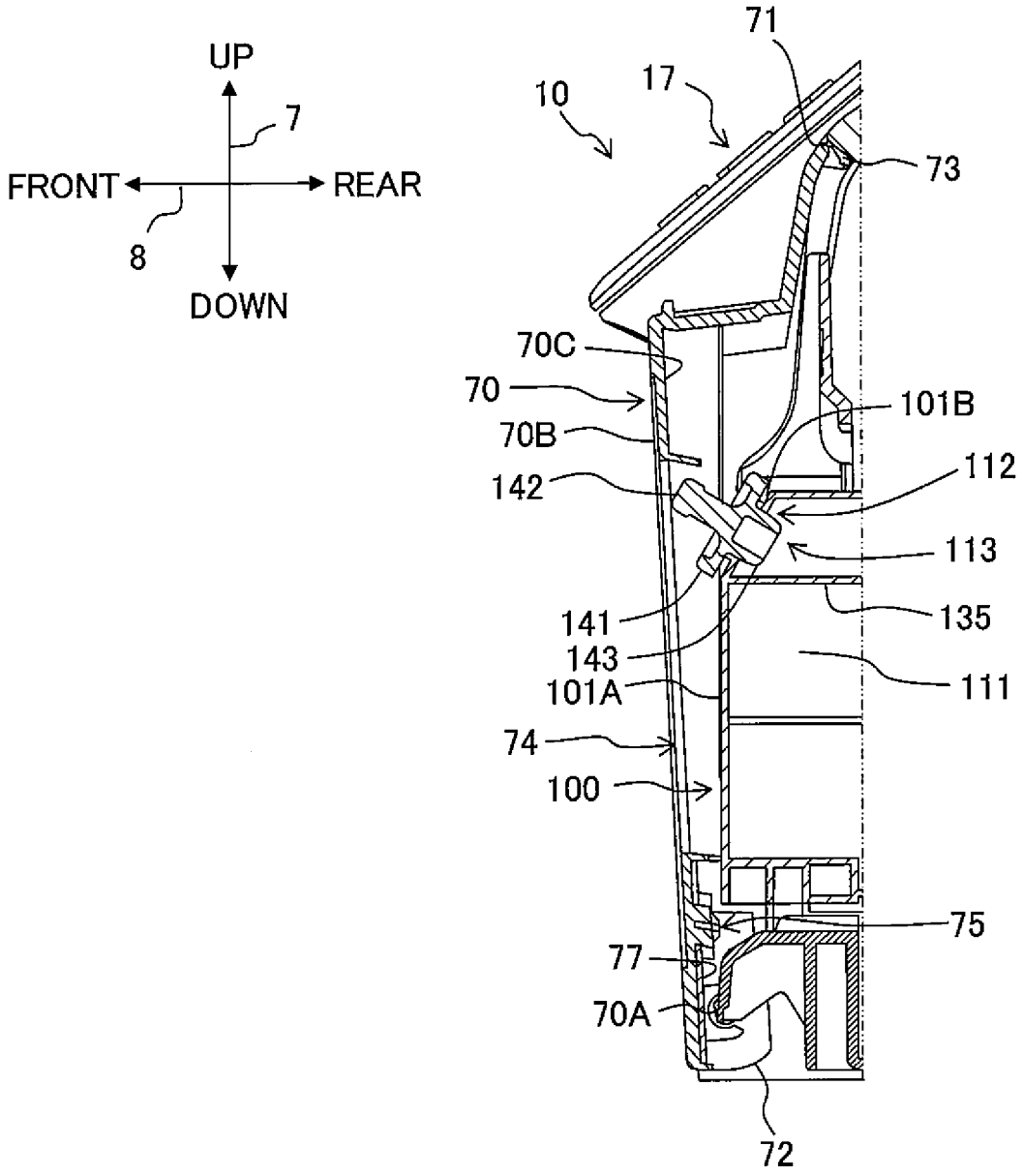
FIG. 16 is an enlarged cross sectional view of the multifunction peripheral in which the cap is attached to an inlet of the ink tank with the cover closed.
Figure 17:
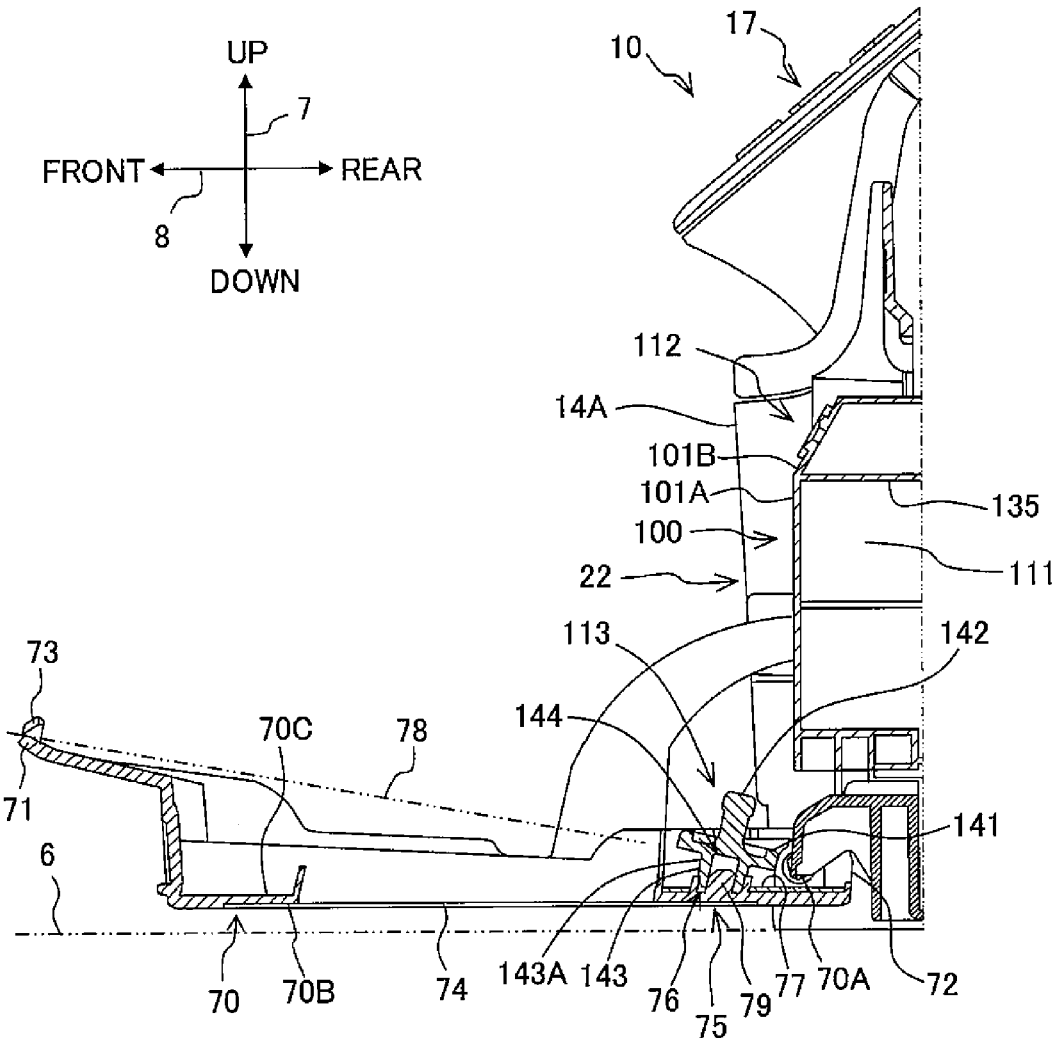
FIG. 17 is an enlarged cross sectional view of the multifunction peripheral in which the cap is held by a holding part with the cover open.
Figure 18:
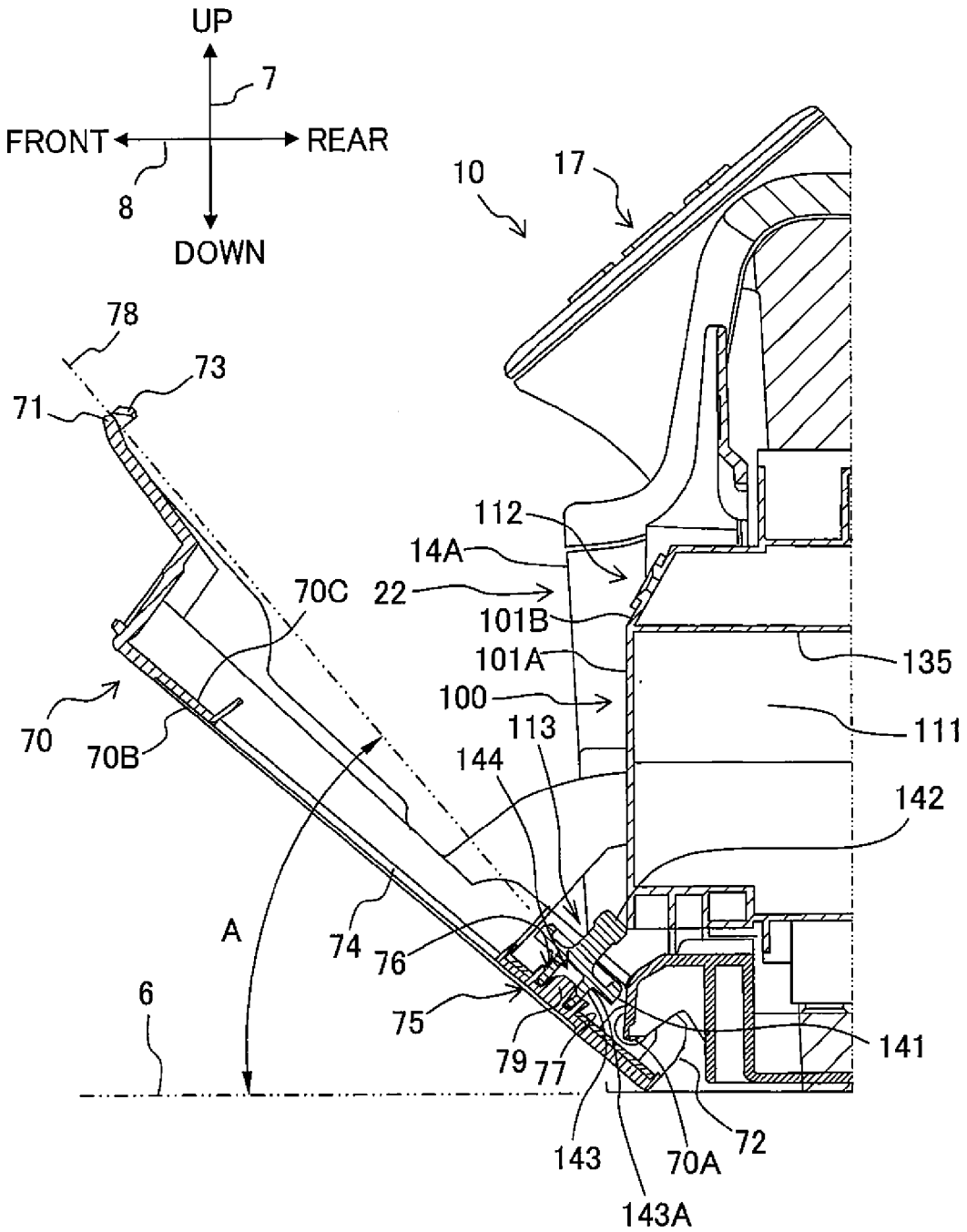
FIG. 18 is an enlarged cross sectional view of the multifunction peripheral in which the cap is held by the holding part to prevent the cover from moving to the closed position.

As depicted in FIGS. 1A, 1B, and 14, the cover 70 is provided to open/close the opening 22 formed in the front wall 14A of the housing 14. The cover 70 swings around the direction extending along the placement surface 6 on which the multifunction peripheral 10 is placed, specifically, around the swing axis 70A extending in the left-right direction 9. The cover 70 has a box shape of which size corresponds to the opening 22, and the cover 70 having the box shape is open at the side of the opening 22. The cover 70 swings between the closed position and the open position around the swing axis 70A as the center of swing. In the closed position, the cover 70 covers the upstanding wall 101A and the inclined wall 101B of the front wall 101 of the ink tank 100 therewith. In the open position, the upstanding wall 101A and the inclined wall 101B of the front wall 101 of the ink tank 100 are exposed to the outside of the housing 14. As depicted in FIGS. 16 to 18, the cover 70 in the closed position includes an outer surface 70B forming a part of the front wall 14A of the housing 14 and an inner surface 70C facing the ink tank 100. An engagement part 73 projecting from the inner surface 70C toward the housing 14 is provided on the side of the upper end 71 of the cover 70. The engagement part 73 keeps the cover 70 in the closed position by being engaged with the vicinity of the upper end of the opening 22 of the housing 14.

A window 74 is formed in the center of the cover 70 in the closed position in the up-down direction 7 and the left-right direction 9. The window 74 allows light to pass between the outer surface 70B and the inner surface 70C of the cover 70. The window 74 is formed, for example, of a transparent material which is placed or embedded in the opening to make visible light pass. The window 74 has a size such that the upper part of the lower end of the upstanding wall 101A and the lower part of the upper end of the inclined wall 101B of the front wall 101 of the ink tank 100 in the up-down direction 7 can be visually confirmed from the side of the front wall 14A of the housing 14 and that the front wall 101 except for the left and right ends in the left-right direction 9 can be visually confirmed.

The window 74 may be formed only of the opening, but in such a case, it is preferred that the window 74 have a size as follows. That is, when the cover 70 is in the closed position, no user can access the cap 113 closing the inlet 112 of the ink tank 100 via the window 74. For example, the window 74 preferably has a size such that the upper part of the lower end of the upstanding wall 101A and the lower part of the upper end of the upstanding wall 101A of the front wall 101 of the ink tank 100 in the up-down direction 7 can be visually confirmed from the side of the front wall 14A of the housing 14.

Four holding parts 75B, 75M, 75C, and 75Y (exemplary holders) are arranged in a row in the left-right direction 9 in the inner surface 70C of the cover 70. The holding parts 75B, 75M, 75C, and 75Y are configured to be positioned below the window 74 when the cover 70 is in the closed position (i.e., the positions closer to the lower end 72 than to the upper end 71). The four holding parts 75B, 75M, 75C, and 75Y correspond to the four caps 113B, 113M, 113C, and 113Y, respectively. Further, the four holding parts 75B, 75M, 75C, and 75Y are configured to be positioned on the slightly right sides, of the four inlets 112B, 112M, 112C, and 112Y corresponding thereto respectively, in the left-right direction 9, when the cover 70 is in the open position. The positions of the four holding parts 75B, 75M, 75C, and 75Y, however, are not limited to those. The four holding parts 75B, 75M, 75C, and 75Y may be configured to be positioned to face the inlets 112B, 112M, 112C, and 112Y, respectively.

The four holding parts 75B, 75M, 75C, and 75Y are disposed at mutually different positions in the left-right direction 9, but they have the same structure. Thus, in the following, the holding parts 75B, 75M, 75C, and 75Y will be represented as "holding part 75" and an explanation of the holding part 75 will be made in detail. As depicted in FIG. 14 and FIGS. 16 to 18, the holding part 75 has a cylindrical shape projecting from the inner surface 70C of the cover 70. The outer diameter of the holding part 75 is greater than the outer diameter of the convex part 143 of the cap 113. The holding part 75 has a circular concave part 76 (an exemplary liquid storage part) which is formed to be open on the projecting end side. A convex part 79 is provided to extend toward the projecting end of the holding part 75 in the center of the bottom of the concave part 76. The convex part 143 of the cap 113 is inserted into the concave part 76. Inserting the convex part 143 of the cap 113 into the concave part 76 of the holding part 75 causes the convex part 79 of the holding part 75 to be inserted into the concave part 144 of the cap 113. The inner diameter of the concave part 76 is substantially same as the outer diameter of the convex part 143, and the outer diameter of the convex part 79 is substantially same as the inner diameter of the concave part 114. In a state that the convex part 143 of the cap 113 is inserted into the concave part 76, the outer surface 143A of the convex part 143 is brought into contact with the inner surface of the concave part 76 to generate the frictional force to the extent not allowing the cap 113 to fall off from the holding part 75 due to the self- weight. Thus, the cap 113 is held in the state of being inserted into the concave part 76, even when the cover 70 swings from the open position to the closed position. Further, even when the cover 70 is in the closed position, the ink entering the concave part 76 is stored in the concave part 76 because of surface tension. Specifically, even when the cover 70 is in the closed position, the ink entering the concave part 76 is stored between the inner surface of the concave part 76 and the outer surface of the convex part 79.

An ink pad 77 (an exemplary liquid holding member) is provided in the inner surface 70C of the cover 70 around the holding part 75. The ink pad 77 is, for example, non-woven fabric having a three-dimensional network which can absorb and hold the ink. The ink pad 77 may be disposed at the concave part 76 of the holding part 75. The ink pad 77 may be formed to have the labeling which indicates each of the ink colors corresponding to one of the holding parts 75.

<Sensor 80>

Figure 15:
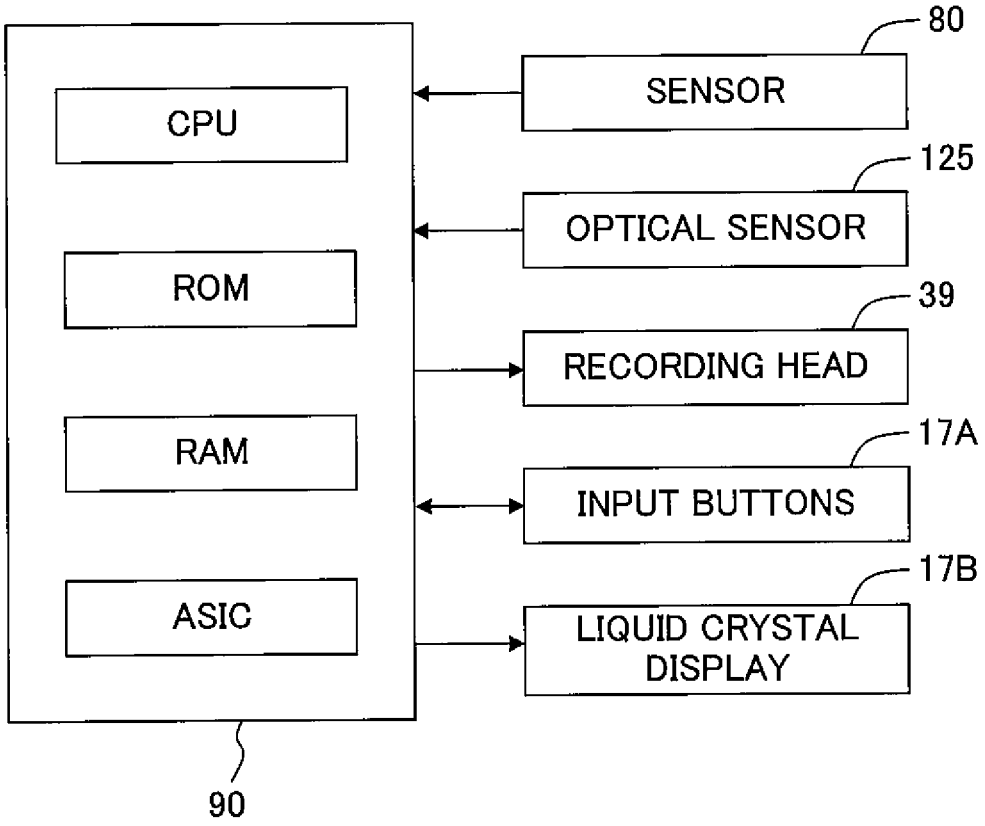
FIG. 15 is a block diagram illustrating a controller.

As depicted in FIG. 14, a sensor 80 is provided at the upper right corner of the opening 22 of the housing 14. The sensor 80 is a mechanical switch. The sensor 80 is turned on by being brought into contact with the cover 70 in the closed position, and the sensor 80 is turned off by swinging the cover 70 to be separated from the sensor 80. As depicted in FIG. 15, the sensor 80 in an on-state outputs a signal indicating the on-state to a controller 90 (an exemplary judgment unit, not depicted in the drawings) of the printer unit 11. The controller 90 is an arithmetic device including CPU, ROM, RAM, ASIC, and the like mounted in the control board. The controller 90 judges whether or not the cover 70 is in the closed position depending on the output signal of the sensor 80. For example, when the sensor 80 is not in the on-state, in other words, when the sensor 80 is in an off-state, the controller 90 judges that the cover 70 is not in the closed position. The controller 90 displays, on the liquid crystal display 17B of the operation panel 17, the information indicating that the cover 70 is not in the closed position, upon the above judgment. In addition to or instead of the information displayed on the liquid crystal display 17B, the controller 90 allows a speaker (not depicted) to generate buzzer sound or may light a LED lamp indicating warning in order to give out the information.

<Attachment of Cap 113 to Holding Part 75>

When the multifunction peripheral 10 is in the usable state, as depicted in FIGS. 1A and 16, the inlet 112 of the ink tank 100 is sealed with the cap 113, and the opening 22 of the front wall 14A of the housing 14 is closed with the cover 70 in the closed position. When the multifunction peripheral 10 is in the usable state, the front wall 14A extends in the direction intersecting with the placement surface 6 on which the multifunction peripheral 10 is placed.

When the ink in each of the ink chambers 111 of the ink tank 100 is consumed to be insufficient, a user swings the cover 70 from the closed position to the open position as depicted in FIG. 14. This makes it possible for the user to access each of the inlets 112 of the ink tank 100 through the opening 22 of the front wall 14A of the housing 14. Swinging the cover 70 from the closed state to the open state switches the sensor 80 from the on-state to the off-state. The controller 90 judges that the cover 70 is not in the closed position upon the receipt of the output signal of the sensor 80. Then, the controller 90 displays the information indicating that the cover 70 is not in the closed position on the liquid crystal display 17B of the operation panel 17.

After swinging the cover 70 to the open position, a user pulls, the cap 113 corresponding to the ink chamber 111 to which the ink is to be supplied, out of the inlet 112. Then, as depicted in FIG. 17, the user inserts the removed cap 113 into the concave part 76 of the holding part 75 corresponding to the ink chamber 111 to which the ink is to be supplied. Accordingly, the cap 113 removed from the inlet 112 is held by the holding part 75.

As depicted in FIG. 11, the user replenishes the ink chamber 111 with the ink by inserting the supply port 137 of the ink bottle 136 into the inlet 112. After replenishing the ink chamber 111 with the ink, the user removes the cap 113 from the holding part 75 and inserts the cap 113 into the inlet 112 to seal the inlet 112. After that, the user swings the cover 70 from the open position to the closed position. When the cover 70 returns to the closed position, the sensor 80 switches from the off-state to the on-state and the controller 90 judges that the cover 70 is in the closed position upon the receipt of the output signal of the sensor 80. Then, the controller 90 clears the information, displayed on the liquid crystal display 17B of the operation panel 17, indicating that the cover 70 is not in the closed position.

It is assumed that, after replenishing the ink chamber 111 with the ink, the user attempts to swing the cover 70 from the open position to the closed position in a state that the cap 113 is held by the holding part 75 without sealing the inlet 112 therewith. In this case, the cap 113 held by the holding part 75 is in the movement area of the cover 70. Thus, as depicted in FIG. 18, the cap 113 held by the holding part 75 makes contact with the upstanding wall 101A of the front wall 101 of the ink tank 100 before the cover 70 reaches the closed position. That is, the cap 113 held by the holding part 75 stands or intervenes between the upstanding wall 101A of the front wall 101 of the ink tank 100 and the inner surface 70C of the cover 70. This prevents the cover 70 from swinging to the closed position.

As depicted in FIG. 18, the angle A is less than 90 degrees. The angle A is formed by a virtual straight line 78 and the placement surface 6 on the side of the open position of the cover 70 (i.e. the side of the surface of the front wall 14A of the housing 14), in the state that the cap 113 held by the holding part 75 makes contact with the upstanding wall 101A of the front wall 101 of the ink tank 100, the virtual straight line 78 connecting the swing axis 70A and the upper end 71 of the cover 70 to provide the shortest distance therebetween, the placement surface 6 being a surface on which the multifunction peripheral 10 is placed. Thus, when a user releases his/her hand from the cover 70 in the state that the cap 113 held by the holding part 75 makes contact with the upstanding wall 101A of the front wall 101 of the ink tank 100, the cover 70 swings to the open position by gravity.

[Action and Effect]

According to the multifunction peripheral 10 of this embodiment, the cap 113 is held by the holding part 75. Thus, it is possible to prevent the loss of the cap 113 and the dirt or stain on the placement surface 6 which would be otherwise caused by putting the cap 113 on the placement surface 6. Further, the cap 113 held by the holding part 75 is positioned in the movement area of the cover 70. Thus, the cap 113 held by the holding part 75 stands or intervenes between the upstanding wall 101A of the front wall 101 of the ink tank 100 and the inner surface 70C of the cover 70 before the cover 70 reaches the closed position. This prevents the multifunction peripheral 10 from being used in the state that the inlet 112 of the ink tank 100 is not covered with the cap 113.

In this embodiment, the angle A is less than 90 degrees, the angle A being formed by the virtual straight line 78 and the placement surface 6 on the side of the open position of the cover 70 in the state that the cap 113 held by the holding part 75 makes contact with the upstanding wall 101A of the front wall 101 of the ink tank 100. Thus, when the user releases his/her hand from the cover 70 in the state that the cap 113 held by the holding part 75 makes contact with the upstanding wall 101A of the front wall 101 of the ink tank 100, the cover 70 swings to the open position by gravity. This reminds the user of the forgetting of attachment of the cap 113.

Since the holding part 75 is provided in the inner surface 70C of the cover 70 at the position closer to the lower end 72 than to the upper end 71, it is possible to make the angle A small, the angle A being formed by the virtual straight line 78 and the placement surface 6 on the side of the open position of the cover 70 in the state that the cap 113 held by the holding part 75 makes contact with the upstanding wall 101A of the front wall 101 of the ink tank 100. This allows the user to know the forgetting of attachment of the cap 113, because the cover 70 cannot swing to the closed position immediately after the user begins to swing the cover 70 from the open position to the closed position. Further, the cap 113 is less likely to fall from the holding part 75 during the swing of the cover 70.

The holding part 75 is provided at the position closer to the swing axis 70A than the window 74. Thus, if the ink drops from the holding part 75 along the inner surface 70C, the ink never dirties the window 74.

The holding part 75 includes the concave part 76, and thus the ink entering the concave part 76 from the cap 113 is less likely to drop from the holding part 75.

The ink pad 77 is provided around the holding part 75. Thus, even if the ink drops from the holding part 75, the dropped ink is prevented from flowing to members other than the ink pad 77.

The holding parts 75 are provided corresponding to respective ink colors. Thus, different colors of inks adhering to the caps 113 held by the holding parts 75 respectively are never mixed.

The controller 90 judges whether or not the cover 70 is in the closed position depending on the output signal of the sensor 80. Thus, it is possible, for example, to display the warning that the user needs to close the cover 70 on the liquid crystal display 17B of the operation panel 17 and/or to limit the operation of the printer unit 11 with the cover 70 being not in the closed position.

Modified Embodiments

In the above embodiment, the holding parts 75 are provided in the inner surface 70C of the cover 70. Instead of being provided in the inner surface 70C, the holding parts 75 may be provided in the front wall 101 of the ink tank 100. Alternatively, the holding parts 75 may be provided in the housing 14 provided that the caps 113 held by the holding parts 75 are positioned in the movement area of the cover 70. Further, instead of providing the cover 70 swinging around the swing axis 70A, as depicted in FIGS. 19A to 19D, the ink tank 100 may be configured to be pulled or drawn out of (FIG. 19C) and accommodated in (FIG. 19B) the housing 14 through the opening 22. In such a configuration, the inlets 112 and the holding parts 75 are provided in the upper wall 104 of the ink tank 100. That is, in this modified embodiment, a part of the housing 14 facing the upper wall 104 of the ink tank 100 functions as a cover which covers the inlets 112 therewith. When the ink tank 100 is accommodated in the housing 14, the part of the housing 14 functioning as the cover is in a closed position where the upper wall 104 having the inlets 112 formed therein is covered with the part of the housing 14. When the ink tank 100 is pulled or drawn out, the part of the housing 14 functioning as the cover is positioned in an open position where the upper wall 104 having the inlets 112 formed therein is exposed. When the ink tank 100 moves from the pulled-out state to the accommodated state, the part of the housing 14 functioning as the cover moves from the open position to the closed position. That is, the movement of the cover with respect to the ink tank 100 includes a relative movement between the cover and the ink tank 100.

Figure 19B:
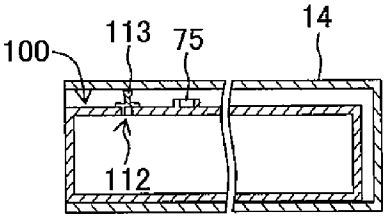
FIG. 19B is a cross-sectional view being taken along the line XIXB-XIXB in FIG. 19A and depicting a state that the ink tank is accommodated.
Figure 19C:
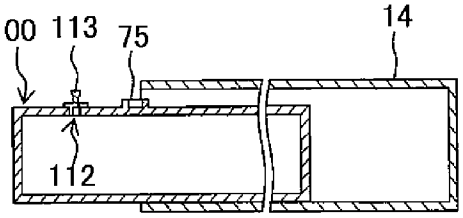
FIG. 19C is a cross-sectional view being taken along the line XIXB-XIXB in FIG. 19A and depicting a state that the inlet is covered with the cap with the ink tank pulled or drawn out.
Figure 19D:
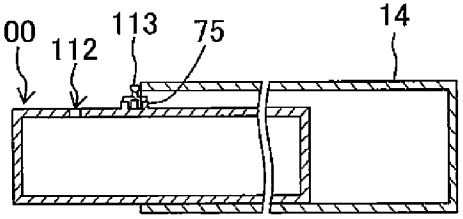
FIG. 19D is a cross-sectional view being taken along the line XIXB-XIXB in FIG. 19A and depicting a state that the cap is held by the holding part with the ink tank pulled or drawn out.
Figure 19A:
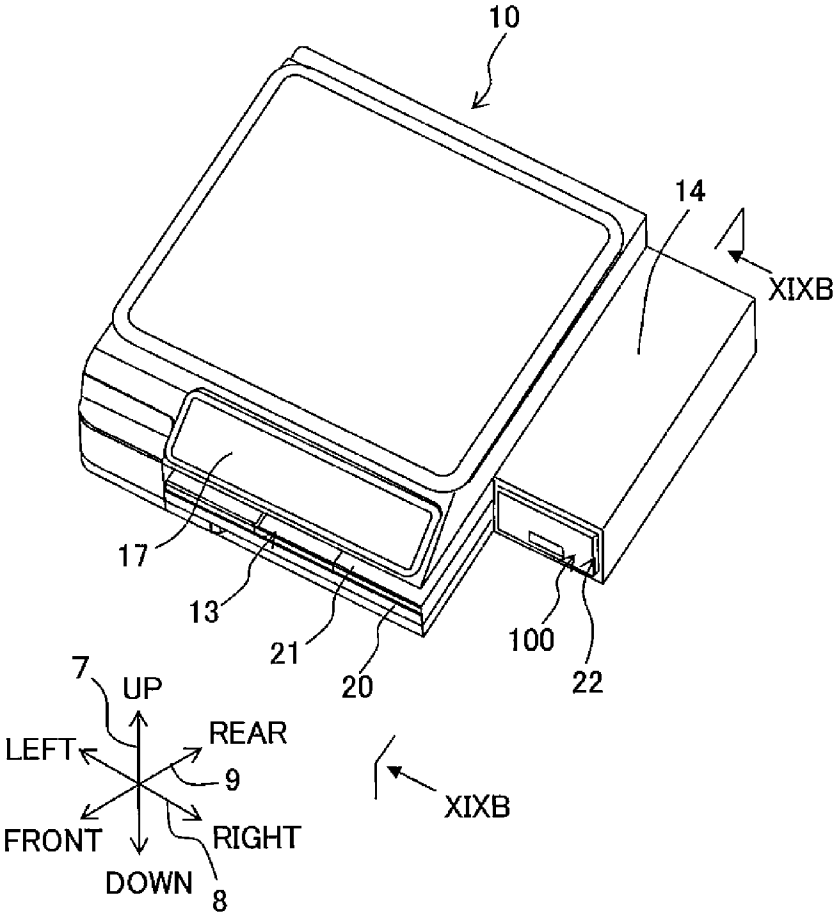
FIG. 19A is a perspective view of the outer appearance of a modified multifunction peripheral.

As depicted in FIG. 19C, the cap 113 can be attachable/detachable with respect to the inlet 112 in the state that the ink tank 100 is pulled or drawn out of the housing 14 through the opening 22, that is, in the state that the part of the housing 14 functioning as the cover is in the open position. Further, as depicted in FIG. 19D, the holding part 75 can hold the cap 113. When the ink tank 100 moves from the pulled-out state to the accommodated state in the state that the holding part 75 holds the cap 113, the cap 113 makes contact with the periphery of the opening 22 of the housing 14. This prevents the ink tank 100 from moving to the accommodated state. That is, since the cap 113 held by the holding part 75 is positioned in the movement area of the part of the housing 14 functioning as the cover, the part of the housing 14 functioning as the cover is prevented from moving to the closed position.

The shape of the holding part 75 may be changed appropriately. For example, the holding part 75 may be formed only of the convex part 79 protruding from the inner surface 70C of the cover 70. In this case, the holding part 75 can hold the cap 113 by inserting the convex part 79 into the concave part 144 of the cap 113. Alternatively, the holding part 75 may be a continuous ring-shaped (circular, elliptical, rectangular) wall which surrounds the outer circumferential surface of the convex part 143 of the cap 113, or a plurality of walls which are separated from each other to surround the outer circumferential surface of the convex part 143 of the cap 113 intermittently.

The arrangement of the holding parts 75 may be changed appropriately. For example, when the dimension of the cover 70 in the left-right direction 9 is sufficiently long, the holding parts 75 may be disposed on the right side or the left side of the window 74 in the left-right direction 9 so as not to overlap with the window 74.

The shape of the cap 113 may be changed appropriately. For example, instead of the shape insertable into the inlet 112 of the ink tank 100, the cap 113 may have a shape to be fitted onto a cylindrical projection formed around the inlet 112. Or, the cap 113 may be configured to seal the inlet 112 such that a male screw formed around the inlet 112 is screwed into a female screw formed in the cap 113.

In the above embodiment, the opening 22 is formed on the right side of the front wall 14A of the housing 14 and the ink tank 100 is disposed on the rear side of the opening 22. The opening 22, however, may be formed on the left side of the front wall 14A and the ink tank 100 may be disposed on the rear side of the opening 22. Or, instead of providing the opening 22 in the front wall 14A of the housing 14, the opening 22 may be formed in the right lateral wall or the left lateral wall so that a user can access the inlets 112 of the ink tank 100 from the right side or the left side.

The above embodiment(s) of the present teaching has been explained by citing the ink as an example of liquid. The present teaching, however, is not limited to this. For example, instead of the ink, it is allowable to use, as the liquid, a pretreatment liquid to be discharged on a recording sheet before the discharge of ink at the time of printing, water to be sprayed in the vicinity of the nozzles 40 of the recording head 39 so as to prevent the nozzles 40 from drying, and the like.

What is claimed is:

1. A liquid-consuming apparatus, comprising:

a tank including a liquid storage chamber configured to store a liquid, an inlet configured to allow the liquid to be poured into the liquid storage chamber, and a liquid flow channel configured to let the liquid flow therethrough from the liquid storage chamber;

a cap configured to be attachable to the tank to cover the inlet;

a cover configured to be movable relative to the tank between a closed position and an open position, the closed position being a position where a surface, of the tank, in which the inlet is formed is covered with the cover, the open position being a position where the surface, of the tank, in which the inlet is formed is exposed; and a holder configured to hold the cap removed from the tank, wherein the cover is configured to be prevented from moving to the closed position by the cap held by the holder and positioned in a movement area of the cover moving from the open position to the closed position.

2. The liquid-consuming apparatus according to claim 1, wherein the holder is disposed at any one of a surface facing the cover in the closed position and an inner surface of the cover facing the tank in a state that the cover is in the closed position.

3. The liquid-consuming apparatus according to claim 2, wherein the holder is disposed at any one of an outer surface, of the tank, facing the cover in the closed position and the inner surface of the cover facing the tank in the state that the cover is in the closed position, and the cover is configured to be prevented from moving to the closed position by the cap held by the holder and positioned between the outer surface of the tank and the inner surface of the cover.

4. The liquid-consuming apparatus according to claim 1, further comprising a housing with an opening, wherein the tank is disposed in the housing so that the surface in which the inlet is formed is accessible through the opening.

5. The liquid-consuming apparatus according to claim 4, wherein the housing includes a side wall extending in a direction, which intersects with a placement surface on which the housing is placed, the opening is formed in the side wall, the cover includes a first end and a second end, and is configured to swing around a swing axis, the first end being an upper end and the second end being a lower end in a state that the cover is in the closed position, the swing axis extending along the placement surface at a position closer to the second end than to the first end, and in a state that the cap held by the holder makes contact with one of the outer surface of the tank facing the cover in the closed position and the inner surface of the cover, an angle, which is formed by the placement surface and a virtual straight line connecting the swing axis and the first end to provide the shortest distance therebetween on a side of the open position of the cover, is less than 90 degrees.

6. The liquid-consuming apparatus according to claim 5, wherein the holder is disposed in the inner surface of the cover at a position closer to the second end than to the first end.

7. The liquid-consuming apparatus according to claim 6, wherein the cover includes a window through which visible light can pass, and the holder is disposed at any one of a position closer to the swing axis than the window and a position not overlapping with the window in a direction along the swing axis.

8. The liquid-consuming apparatus according to claim 4, wherein the housing includes a side wall extending in a direction, which intersects with a placement surface on which the housing is placed, the opening is formed in the side wall, the cover includes a first end, a second end, and a window, and is configured to swing around a swing axis, the first end being an upper end and the second end being a lower end in a state that the cover is in the closed position, the swing axis extending along the placement surface at a position closer to the second end than to the first end, the window being configured to allow visible light to pass therethrough, and the holder is provided at the inner surface of the cover and disposed at any one of a position closer to the swing axis than the window and a position not overlapping with the window in a direction along the swing axis.

9. The liquid-consuming apparatus according to claim 1, further comprising a liquid storage part provided at the holder, and configured to store the liquid in a state that the cover is in the closed position.

10. The liquid-consuming apparatus according to claim 1, further comprising a liquid holding member configured to hold the liquid and disposed at or around the holder.

11. The liquid-consuming apparatus according to claim 1, wherein the cap includes a convex part configured to be inserted into the inlet, and the holder includes a concave part configured to receive the convex part.

12. The liquid-consuming apparatus according to claim 1, wherein the tank includes a plurality of liquid storage chambers as the liquid storage chamber, a plurality of liquid flow channels as the liquid flow channel each configured to let the liquid flow therethrough from a corresponding one of the liquid storage chambers, and a plurality of inlets as the inlet each configured to allow the liquid to be poured into a corresponding one of liquid storage chambers therethrough, the cap is provided as a plurality of caps configured to cover the plurality of inlets therewith, respectively, and the holder is provided as a plurality of holders which correspond to the plurality of caps respectively.

13. The liquid-consuming apparatus according to claim 1, further comprising:

a sensor configured to detect whether or not the cover is in the closed position and to output a signal depending on a detection result;

a judgment unit configured to judge that the cover is not in the closed position depending on the signal outputted from the sensor; and a reporting unit configured to report that the cover is not in the closed position depending on a judgment result of the judgment unit.

* * * * *